US011358360B2

(12) United States Patent
Takano et al.

(10) Patent No.: US 11,358,360 B2
(45) Date of Patent: Jun. 14, 2022

(54) MANUFACTURING METHOD AND MANUFACTURING APPARATUS FOR POUCH CONTAINER

(71) Applicant: FUJI SEAL INTERNATIONAL, INC., Osaka (JP)

(72) Inventors: Tadashi Takano, Osaka (JP); Masahiro Kaminaga, Osaka (JP)

(73) Assignee: FUJI SEAL INTERNATIONAL, INC., Osaka (JP)

( * ) Notice: Subject to any disclaimer, the term of this patent is extended or adjusted under 35 U.S.C. 154(b) by 0 days.

(21) Appl. No.: 17/270,479

(22) PCT Filed: Sep. 13, 2019

(86) PCT No.: PCT/JP2019/036019

§ 371 (c)(1),
(2) Date: Feb. 23, 2021

(87) PCT Pub. No.: WO2020/059647

PCT Pub. Date: Mar. 26, 2020

(65) Prior Publication Data

US 2021/0323261 A1 Oct. 21, 2021

(30) Foreign Application Priority Data

Sep. 19, 2018 (JP) ..... JP2018-175111

(51) Int. Cl.
*B31B 70/64* (2017.01)
*B31B 70/84* (2017.01)
(Continued)

(52) U.S. Cl.
CPC ..... *B31B 70/64* (2017.08); *B31B 70/004* (2017.08); *B31B 70/16* (2017.08); *B31B 70/844* (2017.08);
(Continued)

(58) Field of Classification Search
CPC ..... B31B 70/64; B31B 70/844; B31B 70/004; B31B 70/16; B31B 2160/20;
(Continued)

(56) References Cited

U.S. PATENT DOCUMENTS 4,913,693 A * 4/1990 Ball ..... B65D 33/065 493/239
6,217,497 B1 * 4/2001 Laudenberg ..... B31B 50/00 493/194
(Continued)

FOREIGN PATENT DOCUMENTS

EP 3017940 A1 * 5/2016 ..... B31B 70/00
EP 3674073 A1 * 7/2020 ..... B31B 70/64
(Continued)

OTHER PUBLICATIONS

Official Communication issued in International Patent Application No. PCT/JP2019/036019, dated Dec. 10, 2019.

*Primary Examiner* — Sameh Tawfik
(74) *Attorney, Agent, or Firm* — Keating and Bennett, LLP

(57) ABSTRACT

A plurality of pouch containers are continuously manufactured from materials including: a plurality of separate-type tubular film members each including a portion to be formed as a barrel portion; and a single first belt-shaped film member and a single second belt-shaped film member each including a plurality of portions each to be formed as a gusset portion. The step of closing an opening end of each of the separate-type tubular film members includes: supplying the belt-shaped film member to the opening end by conveying the belt-shaped film member in parallel with the separate-type tubular film members at the same speed as a conveyance speed of the separate-type tubular film members, to cause the belt-shaped film member to overlap with an opened joining margin of each of the separate-type
(Continued)

tubular film members; and joining the joining margin to a portion of the belt-shaped film member that overlaps with the joining margin.

14 Claims, 26 Drawing Sheets

(51) Int. Cl.

| | |
|---|---|
| ***B31B 70/00*** | (2017.01) |
| ***B31B 70/16*** | (2017.01) |
| *B31B 160/20* | (2017.01) |
| *B31B 155/00* | (2017.01) |
| *B65D 75/00* | (2006.01) |
| *B65D 75/58* | (2006.01) |

(52) U.S. Cl.
CPC ..... *B31B 2155/003* (2017.08); *B31B 2160/20* (2017.08); *B65D 75/008* (2013.01); *B65D 75/5883* (2013.01)

(58) Field of Classification Search
CPC . B31B 2155/003; B31B 70/266; B31B 70/36; B31B 70/8123; B31B 70/8132; B65D 75/008; B65D 75/5883
USPC ..... 493/223
See application file for complete search history.

(56) References Cited

U.S. PATENT DOCUMENTS

| | | | | |
|---|---|---|---|---|
| 6,425,847 | B1 * | 7/2002 | Broenstrup | B31B 70/10 493/197 |
| 11,090,897 | B2 * | 8/2021 | Totani | B31B 70/16 |
| 2004/0245270 | A1 * | 12/2004 | Tan | B65D 33/002 221/63 |
| 2012/0195528 | A1 | 8/2012 | Font Lletche | |

FOREIGN PATENT DOCUMENTS

| | | | | |
|---|---|---|---|---|
| JP | 2001-171689 | A | 6/2001 | |
| JP | 2011-046082 | A | 3/2011 | |
| JP | 2013-500890 | A | 1/2013 | |
| JP | 2016-068962 | A | 5/2016 | |
| JP | 2017-030369 | A | 2/2017 | |
| JP | 2018-140519 | A | 9/2018 | |
| WO | WO-2012041738 | A1 * | 4/2012 | B31B 70/00 |

* cited by examiner

MANUFACTURING METHOD AND MANUFACTURING APPARATUS FOR POUCH CONTAINER

TECHNICAL FIELD

The present invention relates to a manufacturing method and a manufacturing apparatus for a pouch container (which may be hereinafter simply referred to as a manufacturing method and a manufacturing apparatus, respectively), and more particularly to a manufacturing method and a manufacturing apparatus for a pouch container having a barrel portion provided with a gusset portion on at least one end side in its axial direction.

BACKGROUND ART

There are various types of pouch containers, such as a stand-up type pouch container having a barrel portion and a bottom gusset portion, a spout-type pouch container having a barrel portion and a spouted top gusset portion, and a stand-up type spouted pouch container having a barrel portion, a bottom gusset portion, and a spouted top gusset portion.

In general, a pouch container having at least one of such a top gusset portion and a bottom gusset portion is often manufactured by joining film members to one another that are prepared as materials including: a front-side film member forming a front wall portion of the barrel portion; a rear-side film member forming a rear wall portion of the barrel portion; and a film member for a gusset portion that is intended to form a gusset portion.

However, in the pouch container manufactured as described above, the front-side film member and the rear-side film member are overlapped with each other and joined to each other, to thereby form precipitous portions along both edges in the width direction of the barrel portion. This causes a problem that the feel of touch is impaired when the pouch container is gripped by a hand.

In order to solve the above-described problem, it is effective to join a film member for a gusset portion to an axial end portion of a tubular film member that has a barrel portion formed by rolling a single film-like member into a tubular shape and joining the end portions of the tubular shape to each other. A pouch container configured in this way is disclosed, for example, in Japanese Patent Laying-Open No. 2001-171689 (PTL 1).

CITATION LIST

Patent Literature

PTL 1: Japanese Patent Laying-Open No. 2001-171689

SUMMARY OF INVENTION

Technical Problem

However, since such a tubular film member having a barrel portion has a three-dimensional shape, it is not easy to join a film member for a gusset portion to this tubular film member, which may causes a problem that the manufacturing process becomes difficult. Pouch containers consumed in large quantities require sufficiently enhanced production efficiency particularly in consideration of mass production.

In this regard, the above-mentioned PTL 1 fails to mention as to how to specifically configure a manufacturing apparatus, but discloses a manufacturing method for a pouch container, by which a stand-up type pouch container having a barrel portion and a bottom gusset portion can be relatively efficiently manufactured.

Specifically, referring to FIG. 8, PTL 1 discloses a manufacturing method for a pouch container, by which a plurality of pouch containers are continuously manufactured as follows. Specifically, a cut is made in advance at a prescribed position in an opening end located on one end side in the axial direction of each of a plurality of tubular film members. A single belt-shaped film member having portions that are to be formed as bottom gusset portions and connected to each other in the long-side direction is folded in the short-side direction. Then, the plurality of tubular film members are sequentially placed on the single belt-shaped film member such that the single belt-shaped film member is sandwiched between the opening ends of the plurality of tubular film members. Then, the plurality of tubular film members and the single belt-shaped film member are joined to each other, from which the single belt-shaped film member is cut off. Thus, a plurality of pouch containers are continuously manufactured.

However, the manufacturing method for a pouch container disclosed in PTL 1 cannot be recognized as achieving sufficiently enhanced production efficiency, and still needs to be improved in many points, for example, as to how to specifically configure the manufacturing apparatus.

Even if the manufacturing method for a pouch container disclosed in PTL 1 is employed as it is, it is difficult to manufacture a spouted pouch container having a barrel portion and a spouted top gusset portion, or a stand-up type spouted pouch container having a barrel portion, a bottom gusset portion, and a spouted top gusset portion. Even if these types of pouch containers can be manufactured, it is still very difficult to efficiently manufacture these pouch containers. Thus, also in this point, the manufacturing method for a pouch container disclosed in PTL 1 still needs to be improved in many points, including as to how to specifically configure the manufacturing apparatus.

Thus, the present invention has been made in consideration of the above-described problems. An object of the present invention is to provide a manufacturing method and a manufacturing apparatus for a pouch container, by which a pouch container having a barrel portion and a gusset portion can be produced in large quantities with high production efficiency.

Solution to Problem

A manufacturing method for a pouch container according to the present invention is to continuously manufacture a plurality of pouch containers from materials including: a plurality of separate-type tubular film members each including a portion to be formed as a barrel portion of a pouch container: a single first belt-shaped film member including a plurality of portions each to be formed as a top gusset portion or a bottom gusset portion of the pouch container; and a single second belt-shaped film member including a plurality of portions each to be formed as a top gusset portion or a bottom gusset portion of the pouch container. The manufacturing method includes: conveying each of the separate-type tubular film members in an aligned state on a conveyance path; closing at least a portion of a first opening end of each of the separate-type tubular film members by a portion of the single first belt-shaped film member in a first attachment process region provided on the conveyance path, wherein the first opening end is located on one end side in an axial direction of each of the separate-type tubular film members; and closing at least a portion of a second opening end of each of the separate-type tubular film members by a portion of the single second belt-shaped film member in a second attachment process region provided on the conveyance path, wherein the second opening end is located on the other end side in the axial direction of each of the separate-type tubular film members.

In the conveying each of the separate-type tubular film members, each of the separate-type tubular film members is disposed on the conveyance path in a state where a conveyance direction on the conveyance path is orthogonal to the axial direction, and flatly folded such that a pair of bent portions are formed at both end portions orthogonal to the axial direction, and a cut is made in each of an end portion close to the first opening end and an end portion close to the second opening end in an extending direction of the pair of bent portions, to allow each of the separate-type tubular film members to be conveyed in a state where a first joining margin and a second joining margin are provided in the first opening end and the second opening end, respectively.

The closing at least a portion of the first opening end of each of the separate-type tubular film members by a portion of the single first belt-shaped film member includes: supplying the single first belt-shaped film member to the first opening end of each of the separate-type tubular film members by conveying the single first belt-shaped film member in parallel with the separate-type tubular film members at a same speed as a conveyance speed of the separate-type tubular film members, so as to cause the single first belt-shaped film member to overlap with the first joining margin of each of the separate-type tubular film members, the first joining margin being in an opened state; and joining the first joining margin of each of the separate-type tubular film members to a portion of the single first belt-shaped film member that overlaps with the first joining margin.

The closing at least a portion of the second opening end of each of the separate-type tubular film members by a portion of the single second belt-shaped film member includes: supplying the single second belt-shaped film member to the second opening end of each of the separate-type tubular film members by conveying the single second belt-shaped film member in parallel with the separate-type tubular film members at a same speed as a conveyance speed of the separate-type tubular film members, so as to cause the single second belt-shaped film member to overlap with the second joining margin of each of the separate-type tubular film members, the second joining margin being in an opened state; and joining the second joining margin of each of the separate-type tubular film members to a portion of the single second belt-shaped film member that overlaps with the second joining margin.

According to the manufacturing method for a pouch container in the present invention, it is preferable that the first attachment process region and the second attachment process region are provided on a same line.

According to the manufacturing method for a pouch container in the present invention, it is preferable that the first attachment process region and the second attachment process region are provided at a same position in the conveyance direction, such that the closing at least a portion of the first opening end of each of the separate-type tubular film members by a portion of the single first belt-shaped film member is performed at a same timing as a timing of performing the closing at least a portion of the second opening end of each of the separate-type tubular film members by a portion of the single second belt-shaped film member.

The manufacturing method for a pouch container in the present invention may further include: feeding a single third belt-shaped film member in a long-side direction of the single third belt-shaped film member; providing pairs of slits at prescribed intervals in the long-side direction in the fed single third belt-shaped film member, wherein slits of each of the pairs of slits are spaced apart from each other in a short-side direction of the single third belt-shaped film member and extend in the long-side direction; rolling the single third belt-shaped film member into a tube shape in a direction orthogonal to a feed direction of the single third belt-shaped film member, and joining end portions in the short-side direction of the rolled single third belt-shaped film member, to fabricate a single elongated tubular film member; and dividing the single elongated tubular film member along a line crossing each of the pairs of slits to fabricate the separate-type tubular film members.

The manufacturing method for a pouch container in the present invention may further include: before the supplying the single first belt-shaped film member to the first opening end of each of the separate-type tubular film members, spreading the first joining margin of each of the separate-type tubular film members to be opened in a first spreading process region provided on the conveyance path; and before the supplying the single second belt-shaped film member to the second opening end of each of the separate-type tubular film members, spreading the second joining margin of each of the separate-type tubular film members to be opened in a second spreading process region provided on the conveyance path.

The manufacturing method for a pouch container in the present invention may further include: cutting off a portion of the single first belt-shaped film member from the single first belt-shaped film member in a first cutting process region provided on the conveyance path, wherein the portion of the single first belt-shaped film member closes the first opening end of each of the separate-type tubular film members; and cutting off a portion of the single second belt-shaped film member from the single second belt-shaped film member in a second cutting process region provided on the conveyance path, wherein the portion of the single second belt-shaped film member closes the second opening end of each of the separate-type tubular film members.

According to the manufacturing method for a pouch container in the present invention, one pouch container of a plurality of pouch containers continuously manufactured may be formed at least by: one separate-type tubular film member of the separate-type tubular film members; a portion of the single first belt-shaped film member that closes the first opening end of the one separate-type tubular film member; and a portion of the single second belt-shaped film member that closes the second opening end of the one separate-type tubular film member.

In this case, the one separate-type tubular film member is formed as a barrel portion of the one pouch container, the portion of the single first belt-shaped film member that closes the first opening end of the one separate-type tubular film member is formed as a top gusset portion of the one pouch container, and the portion of the single second belt-shaped film member that closes the second opening end of the one separate-type tubular film member is formed as a bottom gusset portion of the one pouch container.

According to the manufacturing method for a pouch container in the present invention, each of a plurality of the portions in the single first belt-shaped film member that each are to be formed as a top gusset portion of a pouch container may be provided with a spout in advance in a state before each of the plurality of the portions in the single first belt-shaped film member is supplied to the first opening end of each of the separate-type tubular film members.

The manufacturing method for a pouch container in the present invention may further include: dividing each of the separate-type tubular film members into a first tubular film member and a second tubular film member by cutting off each of the separate-type tubular film members at one position in the axial direction, wherein the first tubular film member includes the first opening end closed by the portion of the single first belt-shaped film member, and the second tubular film member includes the second opening end closed by the portion of the single second belt-shaped film member.

According to the manufacturing method for a pouch container in the present invention, it is preferable that the dividing each of the separate-type tubular film members into the first tubular film member and the second tubular film member is performed in a third cutting process region provided on the conveyance path.

According to the manufacturing method for a pouch container in the present invention, one pouch container of a plurality of pouch containers continuously manufactured may be formed at least by: one first tubular film member of a plurality of the first tubular film members; and a portion of the single first belt-shaped film member that closes the first opening end of the one first tubular film member. In this case, the one first tubular film member is formed as a barrel portion of the one pouch container, and the portion of the single first belt-shaped film member that closes the first opening end of the one first tubular film member is formed as a bottom gusset portion of the one pouch container. Also in this case, another pouch container of the pouch containers continuously manufactured may be formed at least by: one second tubular film member of a plurality of the second tubular film members; and a portion of the single second belt-shaped film member that closes the second opening end of the one second tubular film member. In this case, the one second tubular film member is formed as a barrel portion of the another pouch container, and the portion of the single second belt-shaped film member that closes the second opening end of the one second tubular film member is formed as a bottom gusset portion of the another pouch container.

According to the manufacturing method for a pouch container in the present invention, one pouch container of a plurality of pouch containers continuously manufactured may be formed at least by: one first tubular film member of a plurality of the first tubular film members; and a portion of the single first belt-shaped film member that closes the first opening end of the one first tubular film member. In this case, the one first tubular film member is formed as a barrel portion of the one pouch container, and the portion of the single first belt-shaped film member that closes the first opening end of the one first tubular film member is formed as a top gusset portion of the one pouch container. Also in this case, another pouch container of the pouch containers continuously manufactured may be formed at least by: one second tubular film member of a plurality of the second tubular film members; and a portion of the single second belt-shaped film member that closes the second opening end of the one second tubular film member. In this case, the one second tubular film member is formed as a barrel portion of the another pouch container, and the portion of the single second belt-shaped film member that closes the second opening end of the one second tubular film member is formed as a top gusset portion of the another pouch container.

According to the manufacturing method for a pouch container in the present invention, each of a plurality of the portions in the single first belt-shaped film member that each are to be formed as a top gusset portion of a pouch container may be provided with a spout in advance in a state before each of the plurality of the portions in the single first belt-shaped film member is supplied to the first opening end of each of the separate-type tubular film members. Furthermore, each of a plurality of the portions in the single second belt-shaped film member that each are to be formed as a top gusset portion of a pouch container may be provided with a spout in advance in a state before each of the plurality of the portions in the single second belt-shaped film member is supplied to the second opening end of each of the separate-type tubular film members.

A manufacturing apparatus for a pouch container according to the present invention is to continuously manufacture a plurality of pouch containers from materials including: a plurality of separate-type tubular film members each including a portion to be formed as a barrel portion of a pouch container; a single first belt-shaped film member including a plurality of portions each to be formed as a top gusset portion or a bottom gusset portion of the pouch container; and a single second belt-shaped film member including a plurality of portions each to be formed as a top gusset portion or a bottom gusset portion of the pouch container. The manufacturing apparatus includes a conveyance path, a first closing process mechanism, and a second closing process mechanism. On the conveyance path, each of the separate-type tubular film members in an aligned state is conveyed in a state where an axial direction of each of the separate-type tubular film members is orthogonal to a conveyance direction. The first closing process mechanism serves to close at least a portion of a first opening end of each of the separate-type tubular film members by a portion of the single first belt-shaped film member on the conveyance path, wherein the first opening end is located on one end side in the axial direction of each of the separate-type tubular film members. The second closing process mechanism serves to close at least a portion of a second opening end of each of the separate-type tubular film members by a portion of the single second belt-shaped film member on the conveyance path, wherein the second opening end is located on the other end side in the axial direction of each of the separate-type tubular film members.

Each of the separate-type tubular film members is flatly folded such that a pair of bent portions are formed at both end portions orthogonal to the axial direction, and a cut is made in each of an end portion close to the first opening end and an end portion close to the second opening end in an extending direction of the pair of bent portions, to allow each of the separate-type tubular film members to be conveyed on the conveyance path in a state where a first joining margin and a second joining margin are provided in the first opening end and the second opening end, respectively.

The first closing process mechanism includes: a first supply mechanism that supplies the single first belt-shaped film member to the first opening end of each of the separate-type tubular film members by conveying the single first belt-shaped film member in parallel with the separate-type tubular film members at a same speed as a conveyance speed of the separate-type tubular film members, so as to cause the single first belt-shaped film member to overlap with the first joining margin of each of the separate-type tubular film members, the first joining margin being in an opened state; and a first joining mechanism that joins the first joining margin of each of the separate-type tubular film members to a portion of the single first belt-shaped film member that overlaps with the first joining margin.

The second closing process mechanism includes: a second supply mechanism that supplies the single second belt-shaped film member to the second opening end of each of the separate-type tubular film members by conveying the single second belt-shaped film member in parallel with the separate-type tubular film members at a same speed as a conveyance speed of the separate-type tubular film members, so as to cause the single second belt-shaped film member to overlap with the second joining margin of each of the separate-type tubular film members, the second joining margin being in an opened state; and a second joining mechanism that joins the second joining margin of each of the separate-type tubular film members to a portion of the single second belt-shaped film member that overlaps with the second joining margin.

Advantageous Effects of Invention

The present invention can provide a manufacturing method and a manufacturing apparatus for a pouch container, by which a pouch container having a barrel portion and a gusset portion can be produced in large quantities with high production efficiency.

DESCRIPTION OF EMBODIMENTS

Figure 1:
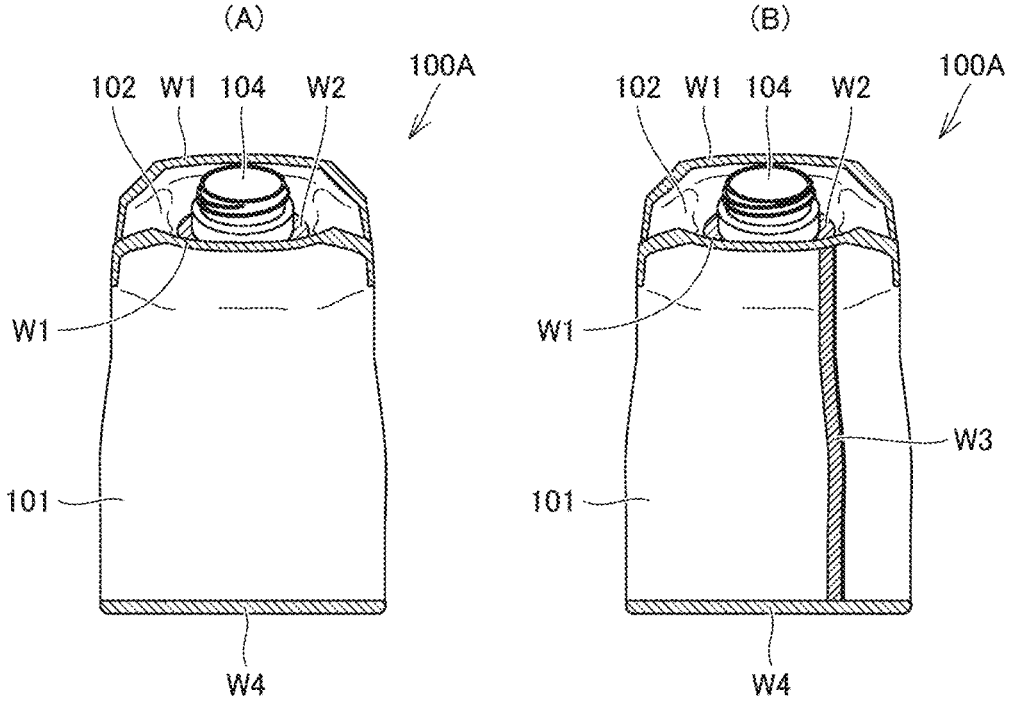
FIG. 1 is a perspective view showing an external shape of a pouch container manufactured in accordance with a manufacturing method for a pouch container according to the first embodiment of the present invention.

In the following, embodiment of the present invention will be described in detail with reference to the accompanying drawings. In the embodiments described below, the same or corresponding portions will be denoted by the same reference characters, and the description thereof will not be repeated.

First Embodiment

FIG. 1 is a diagram showing an external shape of a pouch container manufactured in accordance with a manufacturing method for a pouch container according to the first embodiment of the present invention. FIG. 1(A) is a perspective view showing a front surface and a top surface of the pouch container. FIG. 1(B) is a perspective view showing a back surface and a top surface of the pouch container. Referring to FIG. 1, a pouch container 100A manufactured in accordance with the manufacturing method for a pouch container according to the present embodiment will be first described. In FIG. 1, portions corresponding to welding portions W1 to W4 (described later) are represented by oblique lines in order to facilitate understanding (the same also applies to FIGS. 2, 3, 7, 8, and 10 to 13).

As shown in FIGS. 1(A) and 1(B), pouch container 100A is a so-called spouted pouch container, and mainly includes a barrel portion 101, a top gusset portion 102, and a spout 104. Spout 104 is provided in top gusset portion 102. A cap (not shown) is detachably attached to spout 104.

Barrel portion 101 is formed of a tubular film member formed by welding together circumferential end portions of a single film-like member in a rolled state. Thus, while a welding portion W3 extending in the up-down direction is located at a prescribed position on the back surface side of barrel portion 101, no precipitous portion exists on the outer circumferential surface of barrel portion 101 (particularly, at both edges of barrel portion 101 in its width direction), thereby allowing excellent feel of touch.

Top gusset portion 102 is formed of a film member intended for a gusset portion and welded to one end in the axial direction of barrel portion 101 so as to close this one end of barrel portion 101. Thereby, a welding portion W1 having a frame shape in a plan view is located on the boundary between barrel portion 101 and top gusset portion 102 in the state where top gusset portion 102 is spread in a planar shape. Thus, welding portion W1 forms a joint between barrel portion 101 and top gusset portion 102.

Spout 104 is formed of a cylindrical member having an outer circumferential surface provided with an external thread, and welded to top gusset portion 102 so as to cover a hole portion provided in a central portion of top gusset portion 102. Thereby, a welding portion W2 is located to surround the hole portion provided in top gusset portion 102. Thus, this welding portion W2 forms a joint between top gusset portion 102 and spout 104.

Furthermore, the other end in the axial direction of barrel portion 101 is closed by welding together wall portions of barrel portion 101 that face each other in the state where barrel portion 101 is flatly folded. Thereby, a welding portion W4 extending in the right-left direction is located at the other end of barrel portion 101.

In this case, the tubular film member forming barrel portion 101 and the film member intended for a gusset portion and forming top gusset portion 102 each are formed of a film member made of resin, for example. This film member made of resin is preferably formed as a stack of: a base film layer exhibiting the basic performance (shock resistance, wear resistance, heat resistance, and the like) as a package body; and a sealant layer for allowing welding. The film member made of resin is in some cases formed as a stack including: not only such a base film layer and a sealant layer; but also a barrier layer interposed between the base film layer and the sealant layer and exhibiting additional performance such as high gas barrier performance and light shielding performance.

Examples of the materials forming the base film layer may be: polyester represented by polyethylene terephthalate, polyethylene naphthalate, poly-butylene terephthalate, polycarbonate, and the like; polyolefin represented by polyethylene, polypropylene, and the like; polyamide represented by nylon 6, nylon 66, and the like; polyacrylonitrile; polyimide; polyvinyl chloride; polyvinylidene chloride; polymethyl methacrylate, polyethersulfone; and the like.

Examples of the materials forming the sealant layer may be low-density polyethylene, linear low-density polyethylene, ethylene-propylene copolymer, non-oriented polypropylene, biaxially oriented nylon, ethylene-olefin copolymer, ethylene-acrylic acid copolymer, ethylene-methacrylic acid copolymer, ethylene-vinyl acetate copolymer, and the like.

Examples of the materials forming the barrier layer may be: metals represented by aluminum and the like; resins represented by vinylidene chloride, ethylene-vinyl alcohol copolymer, and the like; aluminium oxide; silica; and the like.

Figure 2:
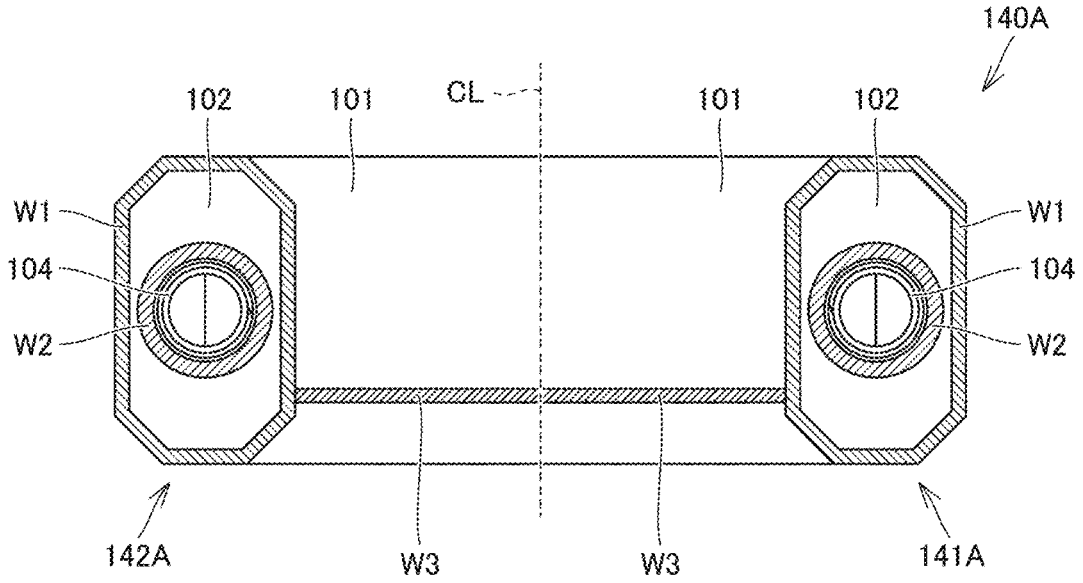
FIG. 2 is a rear view showing an external shape of an undivided bag-shaped film member in one state occurring somewhere during manufacturing of the pouch container shown in FIG. 1.
Figure 3:
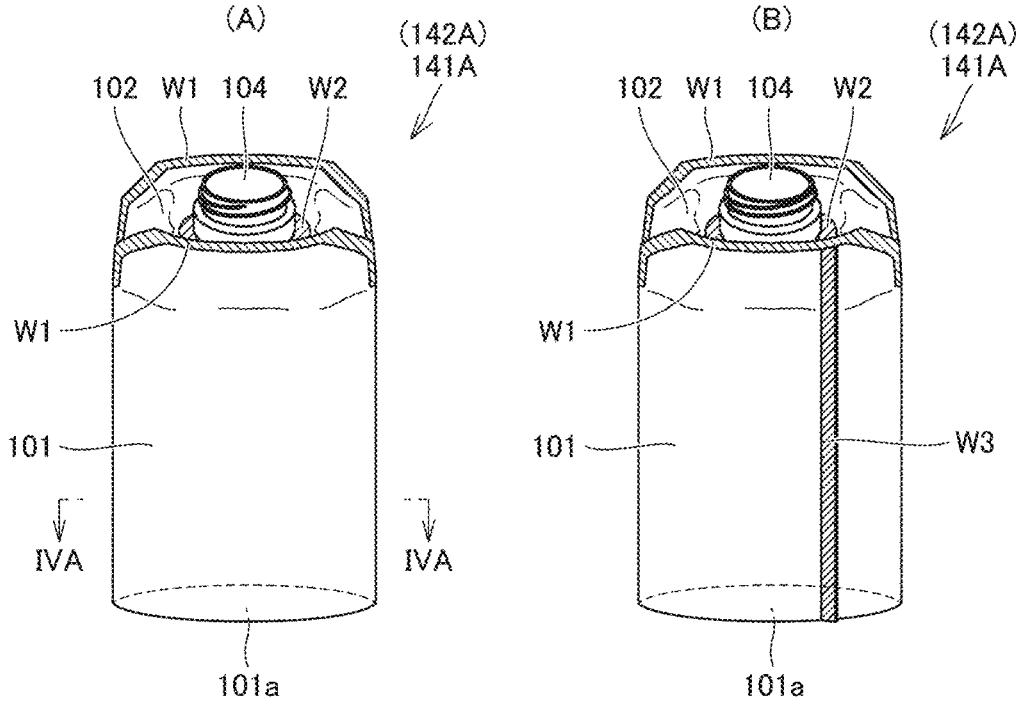
FIG. 3 is a perspective view showing the external shape of a bag-shaped film member in another state occurring somewhere during manufacturing of the pouch container shown in FIG. 1.

FIG. 2 is a rear view showing an external shape of an undivided bag-shaped film member in one state occurring somewhere during manufacturing of the pouch container shown in FIG. 1. FIG. 3 is a view showing the external shape of a bag-shaped film member in another state occurring somewhere during manufacturing of the pouch container shown in FIG. 1. FIG. 3(A) is a perspective view showing the front surface and the top surface of the bag-shaped film member. FIG. 3(B) is a perspective view showing the back surface and the top surface of the bag-shaped film member. Referring to FIGS. 2 and 3, the state of pouch container 100A during manufacturing shown in FIG. 1 will then be described.

The manufacturing method for a pouch container according to the present embodiment is to continuously manufacture pouch container 100A shown in FIG. 1 in large quantities by performing below-mentioned various processes (cutting, bending, welding, and the like) for the materials mainly including the below-mentioned first to third belt-shaped film members. In this case, a first belt-shaped film member 121A (see FIG. 10) and a second belt-shaped film member 121B (see FIG. 12) each include a plurality of portions each to be formed as top gusset portion 102 of pouch container 100A. A third belt-shaped film member 131 (see FIG. 7) includes a plurality of portions each to be formed as barrel portion 101 of pouch container 100A.

Figure 7:
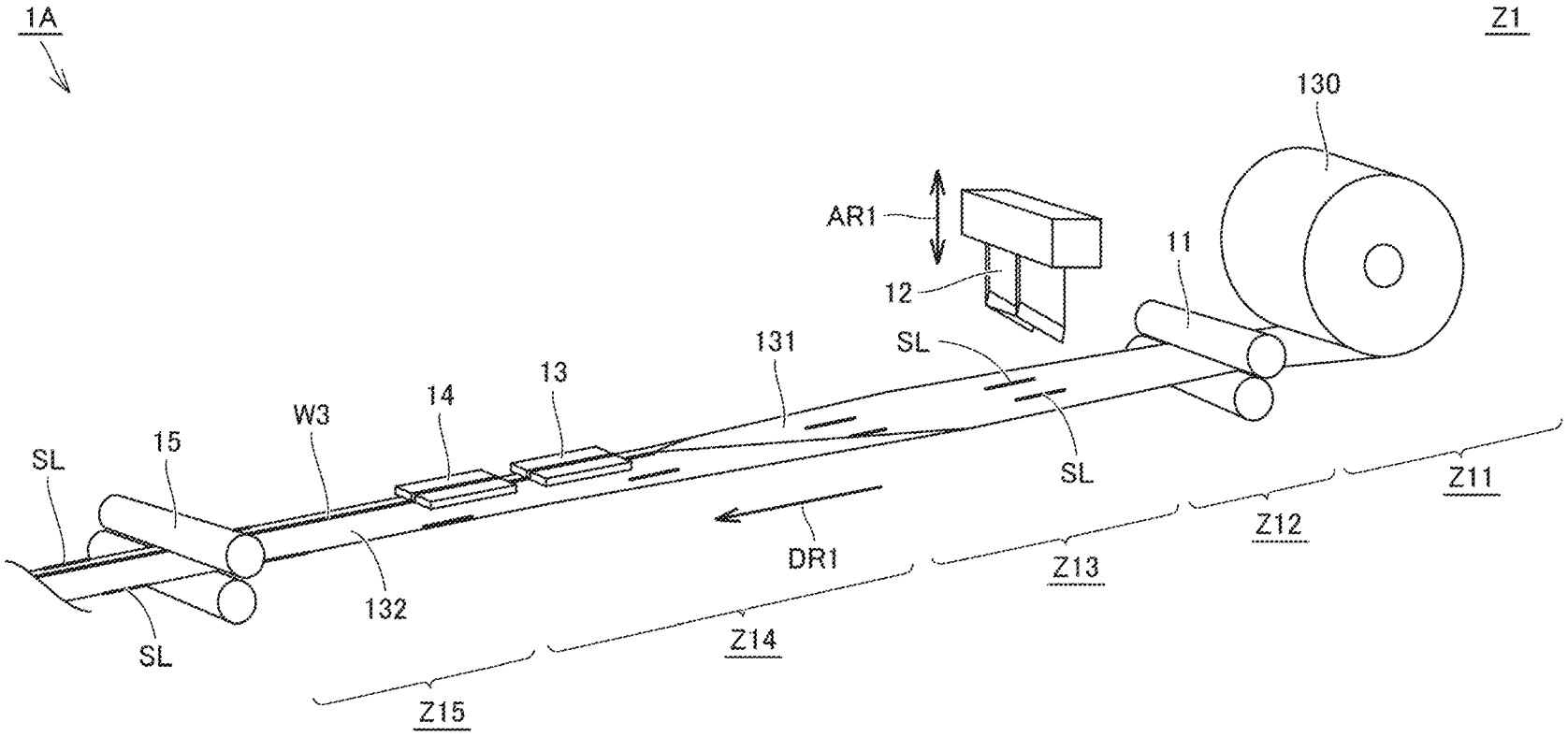
FIG. 7 is a schematic perspective view showing a part of a first process zone in the manufacturing apparatus for a pouch container according to the first embodiment of the present invention.
Figure 8:
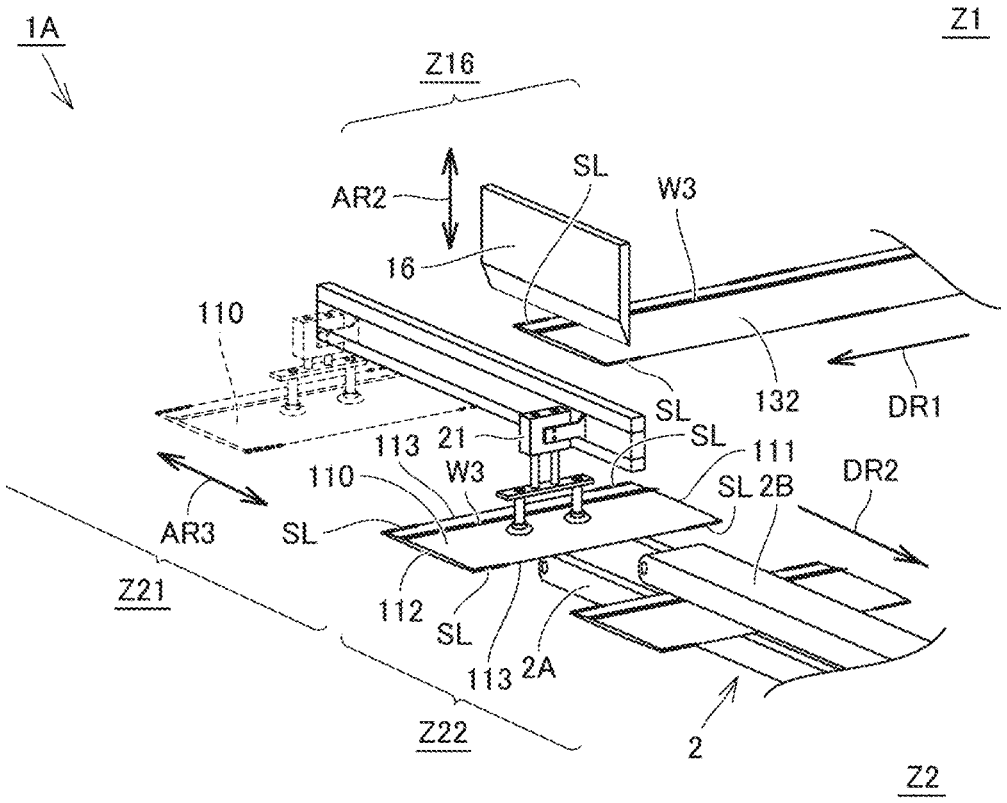
FIG. 8 is a schematic perspective view showing another part of the first process zone and a second process zone in the manufacturing apparatus for a pouch container according to the first embodiment of the present invention.
Figure 9:
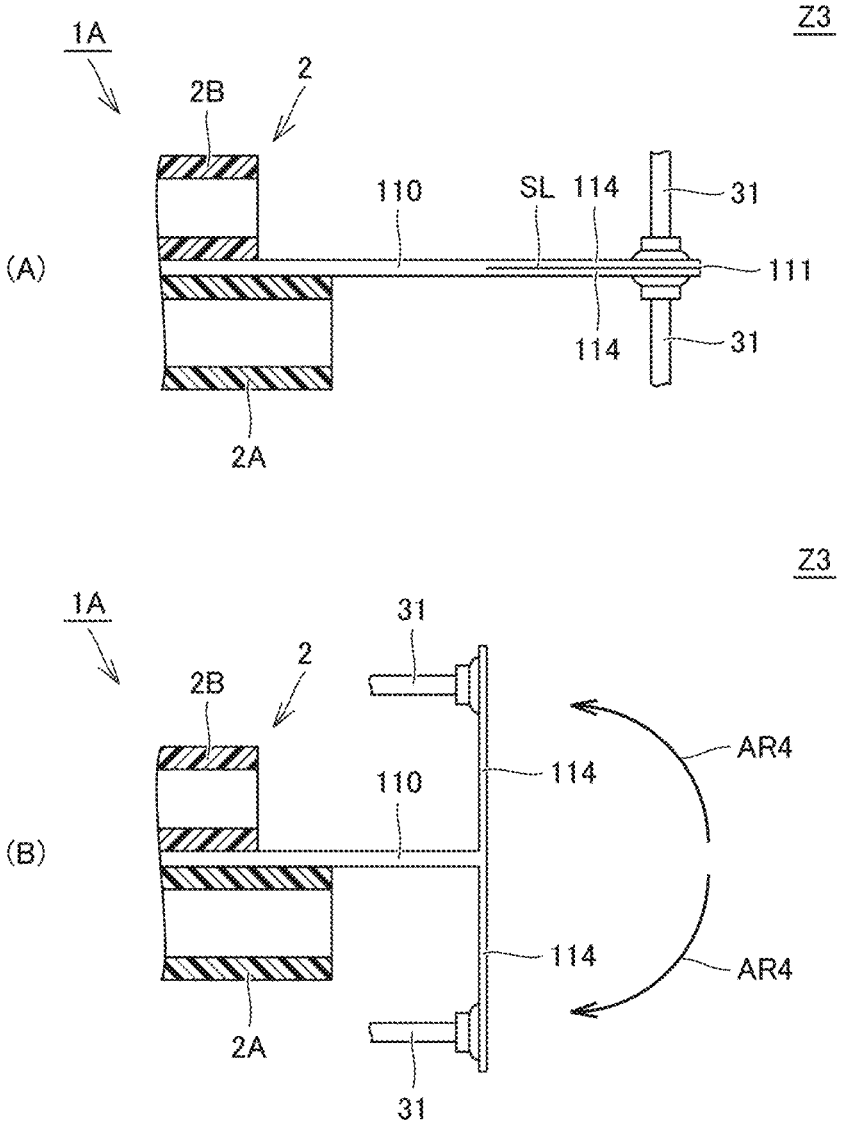
FIG. 9 is a schematic diagram showing an operation in a third process zone in the manufacturing apparatus for a pouch container according to the first embodiment of the present invention.
Figure 10:
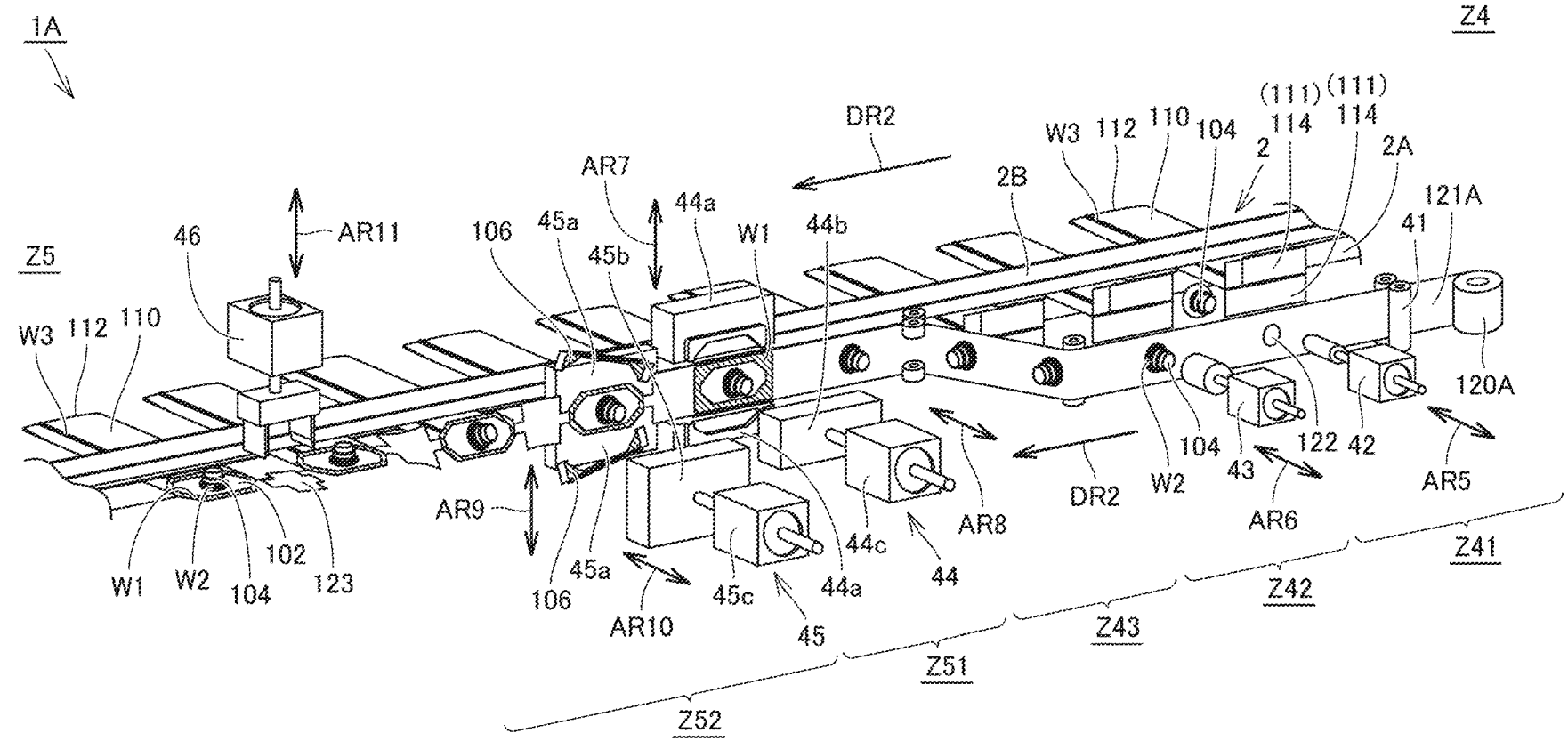
FIG. 10 is a schematic perspective view showing a fourth process zone and a fifth process zone in the manufacturing apparatus for a pouch container according to the first embodiment of the present invention.

Among them, third belt-shaped film member 131 is subjected to the above-mentioned various processes to thereby gradually change its shape into an elongated tubular film member 132 (see FIGS. 7 and 8) and a separate-type tubular film member 110 (see FIGS. 8 to 10). In this case, separate-type tubular film member 110 includes two portions each to be formed as barrel portion 101 of pouch container 100A.

In other words, the manufacturing method for a pouch container according to the present embodiment is to process two pouch containers 100A as one workpiece until one stage somewhere in the manufacturing steps after separate-type tubular film member 110 is fabricated. Then, this one workpiece is divided so as to eventually obtain two pouch containers 100A from this one workpiece. Thus, the state before one workpiece is divided corresponds to the state of undivided bag-shaped film member 140A shown in FIG. 2, and the state after one workpiece is divided correspond to the state of bag-shaped film member 141A (142A) shown in FIG. 3.

As shown in FIG. 2, undivided bag-shaped film member 140A is cut along a cutting line CL shown in the figure so as to be divided into first bag-shaped film member 141A and second bag-shaped film member 142A. The above-mentioned other end in the axial direction of barrel portion 101 of first bag-shaped film member 141A (i.e., the end portion located on the side opposite to the end portion to which top gusset portion 102 is joined) is continuous to the above-mentioned other end in the axial direction of barrel portion 101 of second bag-shaped film member 142A.

Thus, in undivided bag-shaped film member 140A, top gusset portion 102 is welded by welding portion W1 to each of both ends in the axial direction of barrel portion 101, and spout 104 is welded by welding portion W2 to each of these top gusset portions 102. Also, welding portion W3 is formed in barrel portion 101 of first bag-shaped film member 141A and barrel portion 101 of second bag-shaped film member 142A so as to extend over these barrel portions.

On the other hand, as shown in FIGS. 3(A) and 3(B), bag-shaped film member 141A (142A) is different from the above-mentioned pouch container 100A only in shape of the above-mentioned other end in the axial direction of barrel portion 101 (i.e., the end portion located on the side opposite to the end portion to which top gusset portion 102 is joined). Specifically, the other end in the axial direction of bag-shaped film member 141A (142A) is not yet closed but formed as an open end 101*a*. In other words, welding portion W4 (see FIG. 1) is formed at the other end in the axial direction of bag-shaped film member 141A (142A), and thus, manufacturing of pouch container 100A completes.

Referring to FIG. 2, in the present embodiment, welding portion W3 is disposed close to one side on the back surface of undivided bag-shaped film member 140A. Thus, first bag-shaped film member 141A and second bag-shaped film member 142A do not have completely the same shape because welding portions W3 are provided at bilaterally symmetrical positions in these members. However, when welding portion W3 is provided in a central portion on the back surface of undivided bag-shaped film member 140A, first bag-shaped film member 141A and second bag-shaped film member 142A can have completely the same shape.

Figure 4:
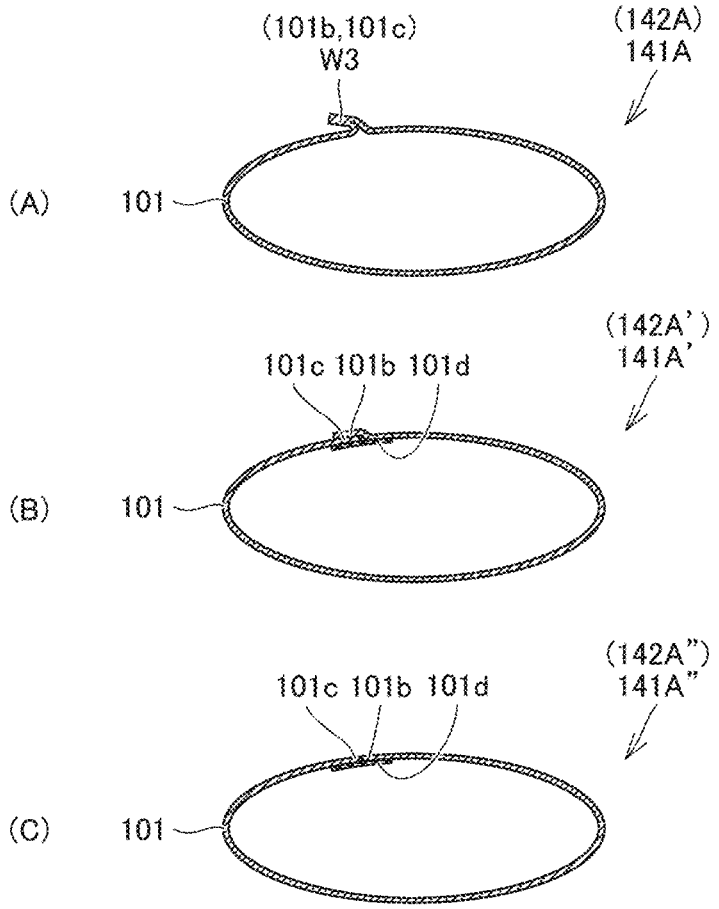
FIG. 4 is a cross-sectional view of the bag-shaped film member, which is taken along a line IVA-IVA shown in FIG. 3, and cross-sectional views of bag-shaped film members according to other configuration examples.

FIG. 4(A) is a cross-sectional view of the bag-shaped film member that is taken along a line IVA-IVA shown in FIG. 3(A). FIGS. 4(B) and 4(C) are cross-sectional views of bag-shaped film members according to other configuration examples. Referring to this FIG. 4, the following describes the configuration of a joining portion formed in a tubular film member that forms barrel portion 101.

As shown in FIG. 4(A), in the present embodiment, barrel portion 101 of bag-shaped film member 141A (142A) is formed in a tube shape by welding together the circumferential end portions of a single film-like member in a rolled state. More specifically, one end portion 101*b* and the other end portion 101*c* of barrel portion 101 in the circumferential direction are pulled out to the outside, so that the inner circumferential surfaces of one end portion 101*b* and the other end portion 101*c* overlap with each other. Then, these portions overlapping with each other are welded to each other to thereby form welding portion W3 as a joining portion. However, the joining portion of barrel portion 101 does not necessarily need to be formed by such welding portion W3, but this joining portion may be formed by another joining method.

For example, as shown in FIG. 4(B), in a bag-shaped film member 141A' (142N), one end portion 101*b* of barrel portion 101 in the circumferential direction is pulled out to the outside of the other end portion 101*c*, so that the inner circumferential surface of one end portion 101*b* overlaps with the outer circumferential surface of the other end portion 101*c*. Then, a seal tape 101*d* is further overlaid from the inner circumferential surface side so as to cover a gap formed between one end portion 101*b* and the other end portion 101*c* while extending along this overlaid portion. In this state, seal tape 101*d* is welded to barrel portion 101 to thereby form the above-mentioned joining portion.

Furthermore, as shown in FIG. 4(C), in bag-shaped film member 141A" (142A"), one end portion 101*b* of barrel portion 101 in the circumferential direction is brought into contact with the other end portion 101*c*, and then, seal tape 101*d* is overlaid from the inner circumferential surface side so as to cover a gap formed between one end portion 101*b* and the other end portion 101*c* while extending along this contact portion. In this state, seal tape 101*d* is welded to barrel portion 101, to thereby form the above-mentioned joining portion.

In this way, the joining portion provided in barrel portion 101 may be variously configured. Any joining portion other than that having the configuration shown in the above-mentioned configuration example is also applicable as long as leakage and the like of the content can be reliably prevented.

Figure 5:
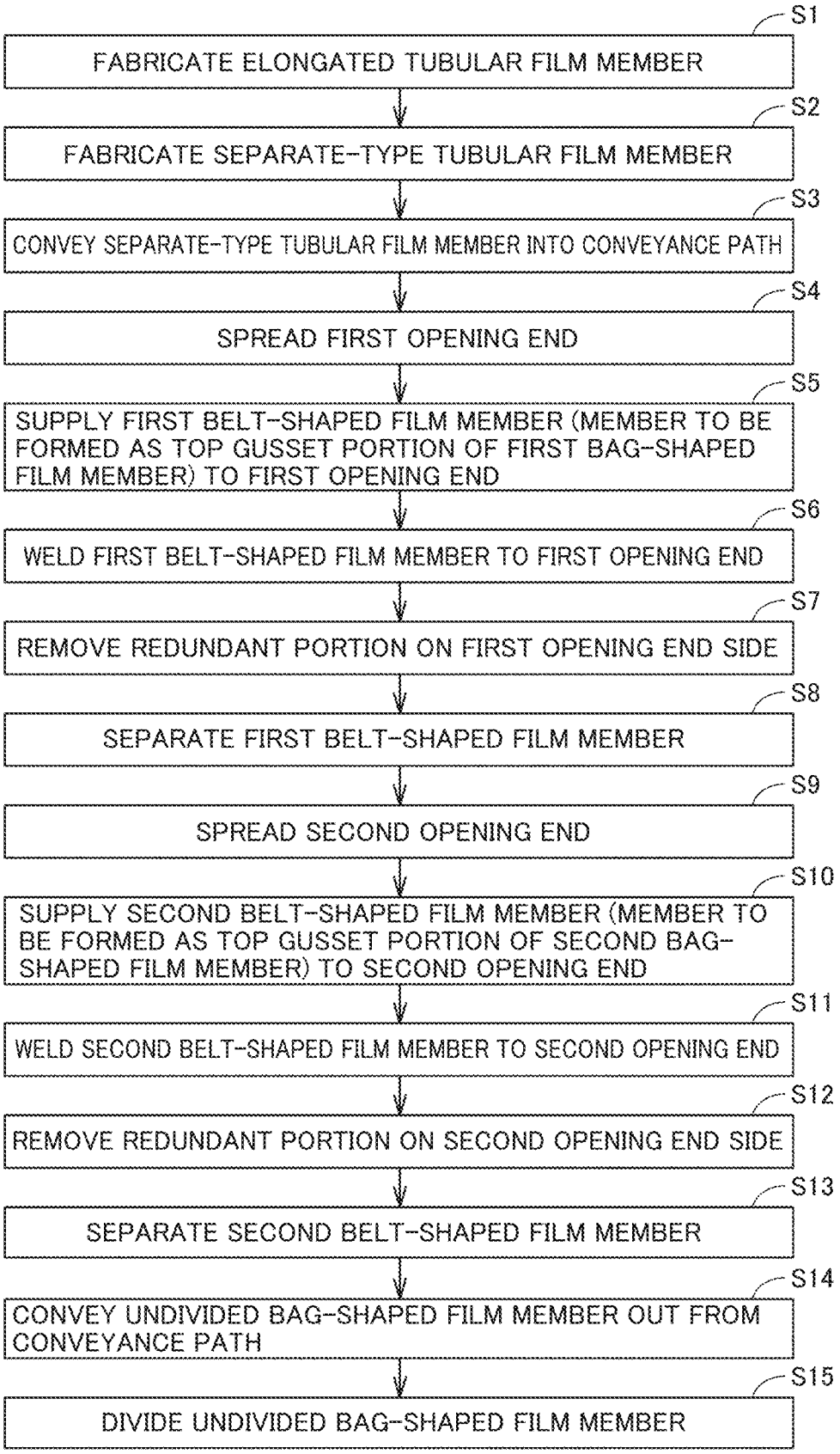
FIG. 5 is a diagram showing a manufacturing flow in accordance with the manufacturing method for a pouch container according to the first embodiment of the present invention.
Figure 6:
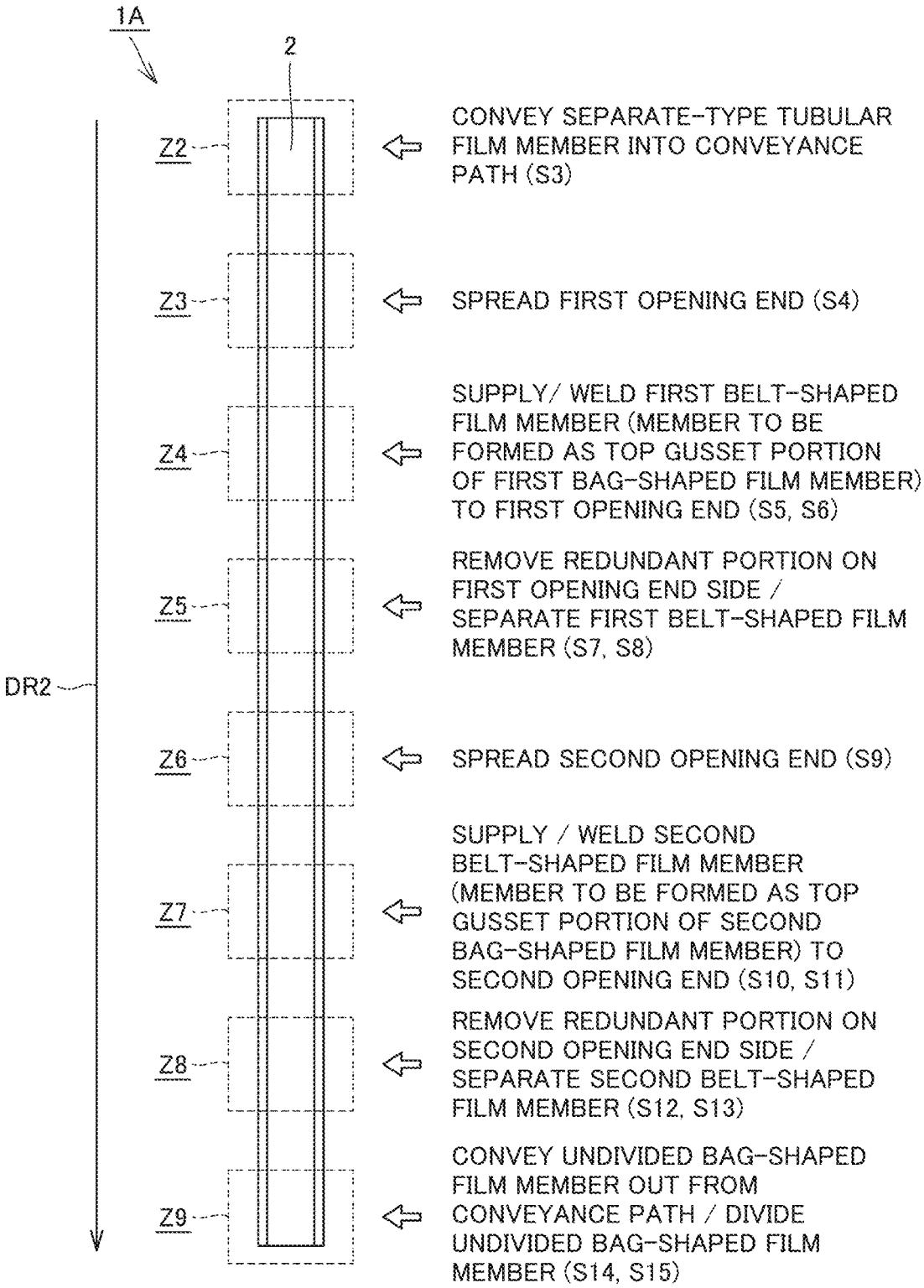
FIG. 6 is a schematic diagram showing a process flow on a conveyance path of a manufacturing apparatus for a pouch container according to the first embodiment of the present invention.
Figure 11:
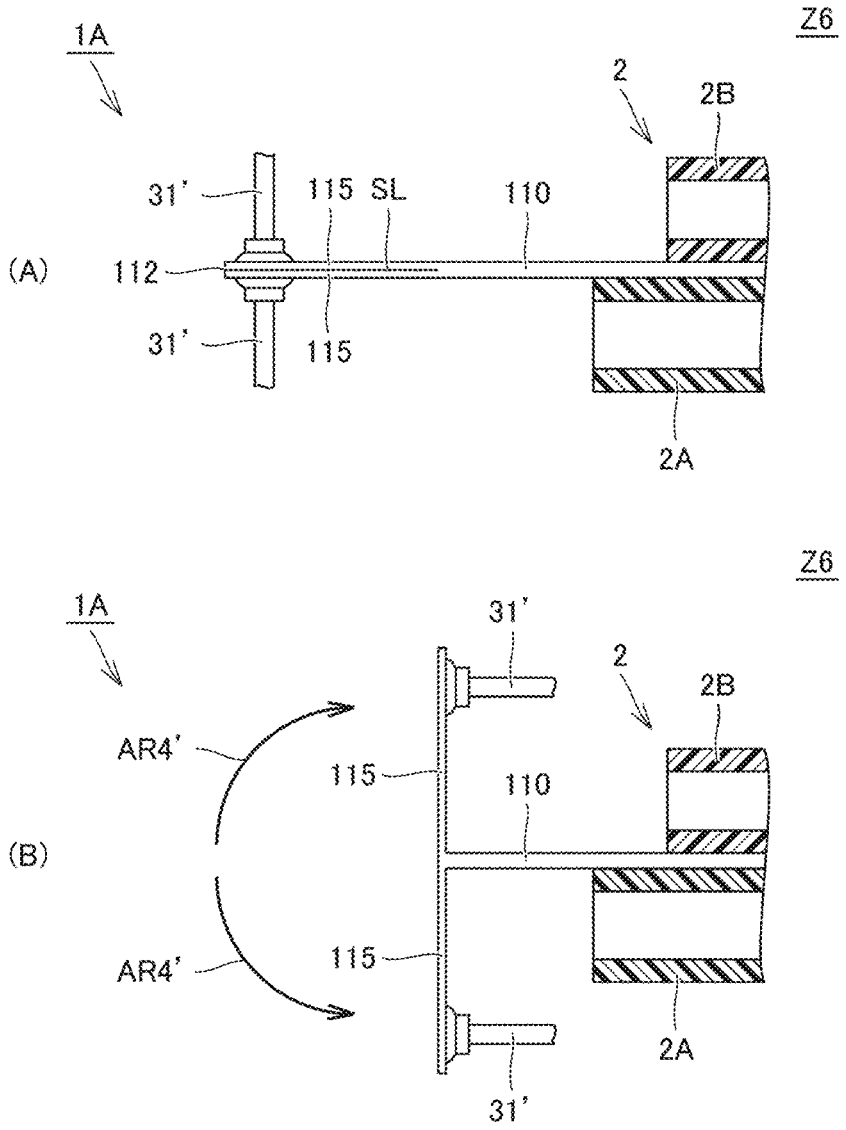
FIG. 11 is a schematic diagram showing an operation in a sixth process zone in the manufacturing apparatus for a pouch container according to the first embodiment of the present invention.
Figure 12:
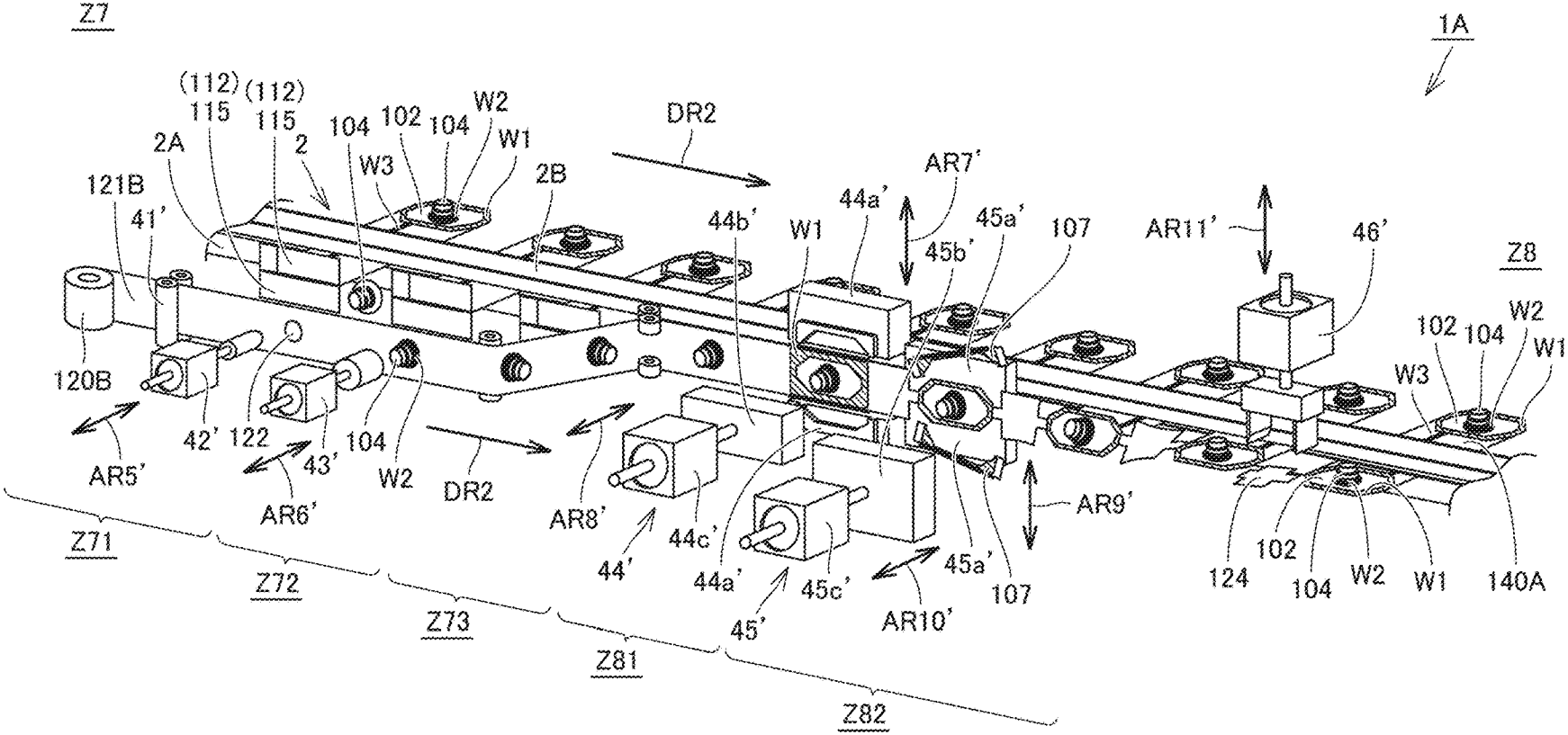
FIG. 12 is a schematic perspective view showing a seventh process zone and an eighth process zone in the manufacturing apparatus for a pouch container according to the first embodiment of the present invention.
Figure 13:
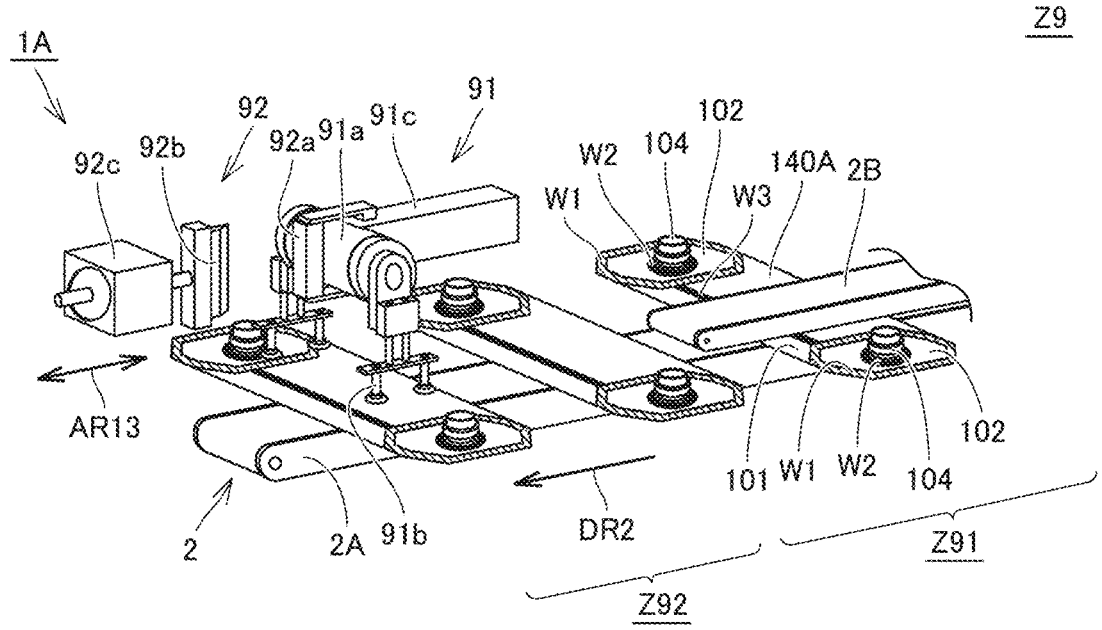
FIG. 13 is a schematic perspective view showing a ninth process zone in the manufacturing apparatus for a pouch container according to the first embodiment of the present invention.
Figure 14:
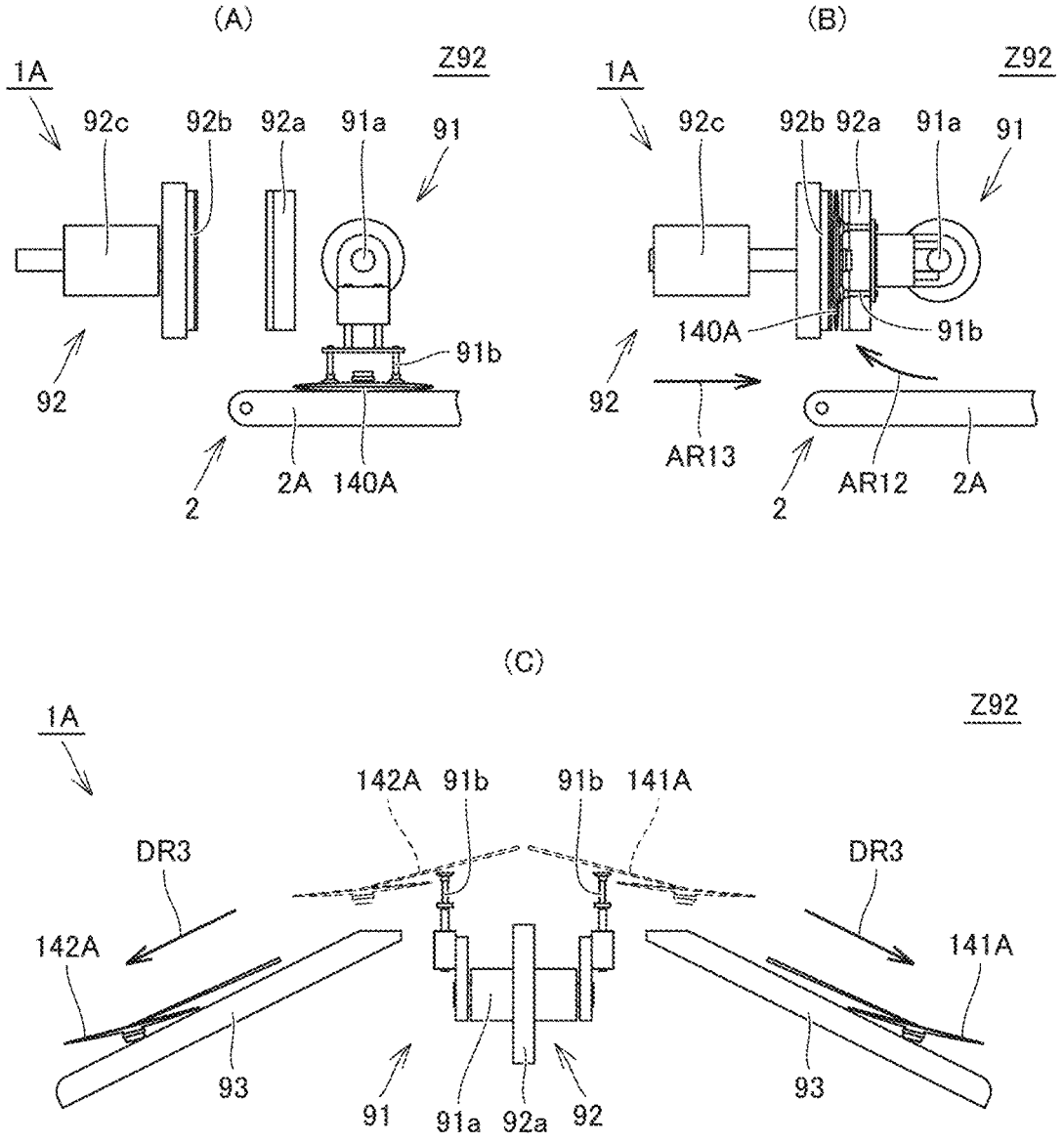
FIG. 14 is a schematic diagram showing an operation in a part of the ninth process zone in the manufacturing apparatus for a pouch container according to the first embodiment of the present invention.

FIG. 5 is a diagram showing a manufacturing flow in accordance with the manufacturing method for a pouch container according to the present embodiment. FIG. 6 is a schematic diagram showing a process flow on a conveyance path of a manufacturing apparatus for a pouch container according to the present embodiment. FIG. 7 is a schematic perspective view showing a part of a first process zone in the manufacturing apparatus for a pouch container according to the present embodiment. FIG. 8 is a schematic perspective view showing another part of the first process zone and a second process zone shown in FIG. 6. FIG. 9 is a schematic diagram showing an operation in a third process zone shown in FIG. 6. FIG. 10 is a schematic perspective view showing a fourth process zone and a fifth process zone shown in FIG. 6. FIG. 11 is a schematic diagram showing an operation in a sixth process zone shown in FIG. 6. FIG. 12 is a schematic perspective view showing a seventh process zone and an eighth process zone shown in FIG. 6. FIG. 13 is a schematic perspective view showing a ninth process zone shown in FIG. 6. FIG. 14 is a schematic diagram showing an operation in a part of the ninth process zone. Referring to these FIGS. 5 to 14, the following describes a manufacturing method and a manufacturing apparatus 1A for a pouch container according to the present embodiment.

Referring FIGS. 5 and 7, elongated tubular film member 132 is first fabricated in step S1. Such fabrication of elongated tubular film member 132 is performed in a first process zone Z1 different from second process zone Z2 to ninth process zone Z9 that have a conveyor-type conveyance path (described later) installed therein, in manufacturing apparatus 1A.

Specifically, as shown in FIG. 7, first process zone Z1 in manufacturing apparatus 1A includes a first zone Z11 to a fifth zone Z15. Third belt-shaped film member 131 is subjected to a prescribed process while it is conveyed to pass through first zone Z11 to fifth zone Z15 in this order. Consequently, elongated tubular film member 132 is fabricated.

In first zone Z11, third belt-shaped film member 131 is fed in its long-side direction (i.e., a feed direction DR1 shown in the figure) from a roll 130 formed by winding single third belt-shaped film member 131. Such feeding of third belt-shaped film member 131 is implemented by intermittent conveyance for conveying third belt-shaped film member 131 in a step feed manner, and specifically implemented by driving a feeding roller 11 at a prescribed interval.

In second zone Z12, a cutting mechanism 12 is used to perform the process of making a cut in third belt-shaped film member 131. Cutting mechanism 12 having a pair of cutting blades moves up and down in the direction indicated by an arrow AR1 shown in the figure, to thereby form a pair of slits SL at specified positions in third belt-shaped film member 131. The pair of slits SL are formed to be spaced apart from each other in the short-side direction of third belt-shaped film member 131 and to extend in the long-side direction of third belt-shaped film member 131.

In third zone Z13, the conveyance direction of third belt-shaped film member 131 is adjusted with a guide member and the like (not shown) such that third belt-shaped film member 131 is rolled into a tube shape in the direction orthogonal to feed direction DR1 (i.e., in the short-side direction).

In fourth zone Z14, a welding mechanism 13 and a cooling mechanism 14 are used to perform the process of welding third belt-shaped film member 131. Welding mechanism 13 has a heater and heats the end portions in the short-side direction of third belt-shaped film member 131 rolled in a tube shape, in the state where these end portions are held by this heater. Cooling mechanism 14 has a cooling block and cools the portions heated by the heater of third belt-shaped film member 131 in the state where the portions are held by this cooling block. Thus, the end portions in the short-side direction of third belt-shaped film member 131 are welded to each other to thereby form welding portion W3. Welding portion W3 eventually appears on the back surface of barrel portion 101 of pouch container 100A.

After having passed through this fourth zone Z14, third belt-shaped film member 131 has an outer shape rolled into a tube shape. Thus, fabrication of elongated tubular film member 132 formed of third belt-shaped film member 131 completes at this point.

In fifth zone Z15, a pressing roller 15 is used to perform the process of folding elongated tubular film member 132. Thereby, elongated tubular film member 132 is flatly folded such that a pair of bent portions are formed at both end portions orthogonal to the axial direction of this elongated tubular film member 132 (the axial direction corresponds to the above-mentioned feed direction DR1). At this time, by appropriately adjusting the positions of a pair of slits SL formed in second zone Z12, the pair of slits SL each are to overlap with the bent portion formed in elongated tubular film member 132.

Referring to FIGS. 5 and 8, separate-type tubular film member 110 is then fabricated in step S2. Such fabrication of separate-type tubular film member 110 is performed in first process zone Z1 of manufacturing apparatus 1A.

Specifically, as shown in FIG. 8, first process zone Z1 of manufacturing apparatus 1A includes a sixth zone Z16 in addition to the above-mentioned first zone 11 to fifth zone Z15. Elongated tubular film member 132 that is flatly folded in fifth zone Z15 is conveyed to sixth zone Z16.

In sixth zone Z16, a cutting mechanism 16 is used to perform the process of cutting elongated tubular film member 132. Cutting mechanism 16 includes a cutting blade extending in the direction orthogonal to the axial direction of elongated tubular film member 132. Thus, cutting mechanism 16 moves up and down in the direction indicated by an arrow AR2 shown in the figure to thereby cut off elongated tubular film member 132 to be divided into a plurality of separate-type tubular film members 110. Thus, each of divided separate-type tubular film members 110 has a first opening end 111 on its one end side in the axial direction and a second opening end 112 on its other end side in the axial direction.

Such cutting and dividing by cutting mechanism 16 is performed by cutting off elongated tubular film member 132 along a line crossing a pair of slits SL located to overlap with the above-mentioned pair of bent portions in elongated tubular film member 132. Thereby, each of the plurality of divided separate-type tubular film members 110 is provided with slit SL as a cut in each of the end portions on the first opening end 111 side and the second opening end 112 side in the extending direction of the pair of bent portions 113.

Referring to FIGS. 5, 6, and 8, then in step S3, separate-type tubular film member 110 is conveyed to the conveyance path. Such conveyance of separate-type tubular film member 110 to the conveyance path is performed in second process zone Z2 of manufacturing apparatus 1A.

Specifically, as shown in FIG. 8, second process zone Z2 of manufacturing apparatus 1A includes a first zone Z21 and a second zone Z22. The plurality of separate-type tubular film members 110 are sequentially conveyed so as to pass through such first zone Z21 and second zone Z22 in this order.

In first zone Z21, a transfer mechanism 21 is used to transfer separate-type tubular film member 110 to a conveyance mechanism 2. Transfer mechanism 21 has a pair of vacuum arms and a guide rail. These vacuum arms hold and release separate-type tubular film member 110 by means of vacuum while moving along the guide rail in the direction indicated by an arrow AR3 in the figure. Thereby, the plurality of separate-type tubular film members 110 that have been cut and divided in the above-mentioned sixth zone of first process zone Z1 are sequentially transferred to conveyance mechanism 2.

In this case, conveyance mechanism 2 is a conveyor-type conveyance mechanism as described above, and more specifically a belt conveyor-type conveyance mechanism including a vacuum-type transporting conveyor 2A and a non-vacuum-type pressing conveyor 2B. Transporting conveyor 2A has an upper surface provided with a conveyance path. Pressing conveyor 2B is disposed to face the upper surface of transporting conveyor 2A. The upstream-side end portion of transporting conveyor 2A has a conveyance inlet portion that is not covered by pressing conveyor 2B. Separate-type tubular film member 110 transferred by transfer mechanism 21 is placed on this conveyance inlet portion.

In this case, each of the plurality of separate-type tubular film members 110 is placed on the conveyance path in the state where the axial direction of each of separate-type tubular film members 110 is orthogonal to a conveyance direction DR2 on the conveyance path. Also at this time, each of the plurality of separate-type tubular film members 110 is placed on the conveyance path in the state where each separate-type tubular film member 110 cut and divided in the sixth zone of first process zone Z1 is flatly folded.

Thereby, the plurality of separate-type tubular film members 110 in an aligned state are conveyed on the conveyance path.

Such conveyance of separate-type tubular film members 110 is implemented by intermittent conveyance for conveying separate-type tubular film members 110 in a step feed manner, and specifically implemented by driving conveyance mechanism 2 at a prescribed interval.

In this case, in separate-type tubular film member 110, the portion on the first opening end 111 side and the portion on the second opening end 112 side each are provided with the above-mentioned one pair of slits SL so as to be spreadable (i.e., such that first opening end 111 and second opening end 112 can be opened), and also form a first welding margin 114 and a second welding margin 115, respectively, to which a portion of first belt-shaped film member 121A and a portion of second belt-shaped film member 121B (each of which will be described later) are respectively welded.

Thus, it is preferable that the width of each of the above-mentioned transporting conveyor 2A and pressing conveyor 2B is smaller than the distance between one pair of slits SL provided on the first opening end 111 side and one pair of slits SL provided on the second opening end 112 side in separate-type tubular film member 110 so as not to prevent spreading of first opening end 111 and second opening end 112. In other words, separate-type tubular film member 110 is placed on the conveyance path such that both end portions of separate-type tubular film member 110 in the axial direction protrude from conveyance mechanism 2 to a considerable extent.

In the present embodiment, manufacturing apparatus 1A is configured such that feed direction DR1 of third belt-shaped film member 131 and elongated tubular film member 132 in first process zone Z1 is orthogonal to conveyance direction DR2 of separate-type tubular film member 110 in second process zone Z2. This configuration eliminates the need to rotate separate-type tubular film member 110 for transfer, so that transfer mechanism 21 can be designed in a simple configuration.

In second zone Z22, separate-type tubular film member 110 having passed through the above-mentioned conveyance inlet portion is sandwiched between transporting conveyor 2A and pressing conveyor 2B. Thus, separate-type tubular film member 110 sandwiched between transporting conveyor 2A and pressing conveyor 2B is maintained in the subsequent process, so that separate-type tubular film member 110 is stably conveyed on the conveyance path without positional misalignment. It should be noted that driving of transporting conveyor 2A and pressing conveyor 2B is controlled such that the belts of transporting conveyor 2A and pressing conveyor 2B rotate at the same speed.

Referring to FIGS. 5, 6, and 9, then in step S4, first opening end 111 of separate-type tubular film member 110 is spread. Such spreading of first opening end 111 is performed in third process zone Z3 of manufacturing apparatus 1A. FIGS. 9(A) and 9(B) show this spreading operation of first opening end 111 over time.

As shown in FIG. 9(A), in third process zone Z3, a plurality of vacuum arms 31 each are first used to hold, with vacuum, a corresponding one of the portions on the upper surface side and the lower surface side of first opening end 111 in separate-type tubular film member 110. These portions on the upper surface side and the lower surface side of first opening end 111 form a pair of first welding margins 114 as described above. Also, a pair of slits SL are provided in both edges of first opening end 111. Thereby, separate spreading is allowed.

Then, as shown in FIG. 9(B), the plurality of vacuum arms 31 are operated to pivot in the directions away from each other (i.e., in the direction indicated by an arrow AR4 shown in the figure), so that one pair of first welding margins 114 in first opening end 111 are also bent to be away from each other. Thereby, first opening end 111 is opened, with the result that first welding margin 114 formed in a planar shape is located on the first opening end 111 side of separate-type tubular film member 110.

In other words, the above-mentioned third process zone Z3 corresponds to the first spreading process region in which first opening end 111 is spread such that first joining margin 114 of separate-type tubular film member 110 is opened.

It is preferable to maintain this opened state of first opening end 111 until a third zone Z43 (see FIG. 10) in fourth process zone Z4 in which welding of first opening end 111 of separate-type tubular film member 110 to a portion of first belt-shaped film member 121A is at least subsequently performed. For example, it is preferable to maintain the above-mentioned state by a separately provided guide member and the like (not shown) when holding by vacuum arms 31 is released.

Referring to FIGS. 5, 6, and 10, then in step S5, first belt-shaped film member 121A is supplied to first opening end 111 of separate-type tubular film member 110. Such supply of first belt-shaped film member 121A is performed in fourth process zone Z4 of manufacturing apparatus 1A. In this case, first belt-shaped film member 121A includes a portion to be formed as top gusset portion 102 of first bag-shaped film member 141A, as described above.

Specifically, as shown in FIG. 10, fourth process zone Z4 of manufacturing apparatus 1A includes a first zone Z41 and a second zone Z42. Among these zones, the plurality of separate-type tubular film members 110 are sequentially conveyed so as to pass through second zone Z42. Single first belt-shaped film member 121A is conveyed so as to pass through first zone Z41 and second zone Z42 in this order.

In first zone Z41, single first belt-shaped film member 121A is fed in its long-side direction from a roll 120A formed by winding single first belt-shaped film member 121A. Such feeding of first belt-shaped film member 121A is implemented by intermittent conveyance for conveying first belt-shaped film member 121A in a step feed manner, and specifically implemented by driving a feeding roller 41 at a prescribed interval.

Also in first zone Z41, a perforation mechanism 42 is used to provide a hole portion 122 in first belt-shaped film member 121A fed by feeding roller 41. Also, spout 104 is inserted into hole portion 122 and welded to first belt-shaped film member 121A by a welding mechanism 43. Perforation mechanism 42 includes a cutting blade and a drive mechanism that drives the cutting blade. The cutting blade moves in the direction indicated by an arrow AR5 shown in the figure to thereby form hole portion 122. Welding mechanism 43 includes a heater and a drive mechanism that drives the heater. The heater moves in the direction indicated by an arrow AR6 shown in the figure to thereby weld spout 104. Thus, spout 104 is attached to first belt-shaped film member 121A with welding portion W2 interposed therebetween.

The present embodiment provides a configuration in which spout 104 is attached to first belt-shaped film member 121A in first zone Z41, as described above. Alternatively, a spouted first belt-shaped film member provided in advance with spouts at prescribed intervals may be used.

In second zone Z42, first belt-shaped film member 121A to which spout 104 is welded is supplied to first opening end 111 of separate-type tubular film member 110 so as to overlap with opened first welding margin 114 of separate-type tubular film member 110. Specifically, by using a guide roller and the like as the first supply mechanism, first belt-shaped film member 121A is conveyed in the same direction as conveyance direction DR2 of separate-type tubular film member 110, and thus, conveyed in parallel with separate-type tubular film member 110 and also conveyed at the same speed as the conveyance speed of separate-type tubular film member 110.

Thereby, in second zone Z42, a portion of first belt-shaped film member 121A is brought into contact with first welding margin 114 of separate-type tubular film member 110. In this case, the timings at which these members are conveyed are synchronously controlled, so that the portion of first belt-shaped film member 121A is brought into contact with first joining margin 114 in the state where spout 104 is properly positioned.

Referring to FIGS. 5, 6, and 10, then in step S6, first belt-shaped film member 121A is welded to first opening end 111 of separate-type tubular film member 110. Such welding of first belt-shaped film member 121A is performed in fourth process zone Z4 of manufacturing apparatus 1A.

Specifically, as shown in FIG. 10, fourth process zone Z4 of manufacturing apparatus 1A includes a third zone 43 in addition to first zone Z41 and second zone Z42 as described above. Separate-type tubular film member 110 and first belt-shaped film member 121A are conveyed to third zone Z43 in the state where a portion of first belt-shaped film member 121A is brought into contact with first welding margin 114 of separate-type tubular film member 110.

In third zone Z43, welding of first belt-shaped film member 121A to first opening end 111 of separate-type tubular film member 110 is performed using a welding mechanism 44 as the first joining mechanism. Welding mechanism 44 includes a pair of movable stages 44*a* divided into an upper stage and a lower stage, a heater 44*b*, and a drive mechanism 44*c*. The pair of movable stages 44*a* are configured to be movable up and down in the direction indicated by an arrow AR7 shown in the figure so as to be movable close to and away from each other. Heater 44*b* is configured to be driven by drive mechanism 44*c* so as to be movable in the direction indicated by an arrow AR8 shown in the figure.

Separate-type tubular film member 110 and first belt-shaped film member 121A that are in contact with each other are disposed at a prescribed position in third zone Z43, so that the pair of movable stages 44*a* move in the directions to be close to each other. Thereby, the pair of movable stages 44*a* are disposed on the rear side of first joining margin 114. In this state, heater 44*b* is driven by drive mechanism 44*c* to be moved toward the pair of movable stages 44*a*. Thereby, heater 44*b* presses first joining margin 114 with first belt-shaped film member 121A interposed therebetween. Thus, a portion of first belt-shaped film member 121A and first joining margin 114 are sandwiched between the pair of movable stages 44*a* and heater 44*b*, and thereby welded to each other.

Thus, the portion of first belt-shaped film member 121A is attached to first opening end 111 of separate-type tubular film member 110 so as to close first opening end 111 with welding portion W1 interposed therebetween. In other words, second zone Z42 and third zone Z43 in fourth process zone Z4 mentioned above correspond to the first attachment process region in which first opening end 111 of separate-type tubular film member 110 is closed by a portion of first belt-shaped film member 121A.

After completion of this welding, the pair of movable stages 44*a* and heater 44*b* move back to their respective retracted positions. Then, these portions having been welded are again conveyed in conveyance direction DR2.

Referring to FIGS. 5, 6, and 10, then in step S7, a redundant portion 106 on the first opening end 111 side in separate-type tubular film member 110 and first belt-shaped film member 121A is removed. Such removal of redundant portion 106 is performed in fifth process zone Z5 of manufacturing apparatus 1A.

Specifically, as shown in FIG. 10, fifth process zone Z5 of manufacturing apparatus 1A includes a first zone Z51, to which the portions of separate-type tubular film member 110 and first belt-shaped film member 121A that have been welded to each other are conveyed.

In first zone Z51, redundant portion 106 on the first opening end 111 side in separate-type tubular film member 110 and first belt-shaped film member 121A is removed using a cutting mechanism 45. Cutting mechanism 45 includes a pair of movable stages 45*a* divided into an upper stage and a lower stage, a cutting blade 45*b*, and a drive mechanism 45*c*. The pair of movable stages 45*a* are configured to be movable up and down in the direction indicated by an arrow AR9 in the figure so as to be movable close to and away from each other. Cutting blade 45*b* is configured to be driven by drive mechanism 45*c* so as to be movable in the direction indicated by an arrow AR10 shown in the figure.

The portions of separate-type tubular film member 110 and first belt-shaped film member 121A that are welded to each other are disposed at a prescribed position in first zone Z51, so that the pair of movable stages 45*a* move in the directions to be close to each other. Thereby, the pair of movable stages 45*a* are disposed on the rear side of first joining margin 114. In this state, cutting blade 45*b* is driven by drive mechanism 45*c* to be moved toward the pair of movable stages 45*a*. Thereby, redundant portion 106 on the first opening end 111 side in separate-type tubular film member 110 and first belt-shaped film member 121A is cut and removed.

After such removal of redundant portion 106 on the first opening end 111 side completes, the pair of movable stages 45*a* and cutting blade 45*b* move back to their respective retracted positions. Then, the above-mentioned welded portions are again conveyed in conveyance direction DR2.

Referring to FIGS. 5, 6, and 10, then in step S8, first belt-shaped film member 121A is separated. Such separation of first belt-shaped film member 121A is performed in fifth process zone Z5 of manufacturing apparatus 1A.

Specifically, as shown in FIG. 10, fifth process zone Z5 of manufacturing apparatus 1A includes a second zone Z52 in addition to the above-mentioned first zone Z51. To this second zone Z52, first belt-shaped film member 121A that connects separate-type tubular film members 110 adjacent to each other in conveyance direction DR2 is conveyed.

In second zone Z52, a cutting mechanism 46 is used to cut first belt-shaped film member 121A. Cutting mechanism 46 having a pair of cutting blades moves up and down in the direction indicated by an arrow AR11 shown in the figure, to thereby cut and remove the portion of first belt-shaped film member 121A that connects separate-type tubular film members 110 adjacent to each other (i.e., the portion indicated by a reference character 123 in the figure).

In other words, second zone Z52 of fifth process zone Z5 mentioned above corresponds to the first cutting process region in which the portion of single first belt-shaped film member 121A that closes first opening end 111 of separate-type tubular film member 110 is cut off from single first belt-shaped film member 121A.

As described above, by the above-mentioned guide roller and the like as the first closing process mechanism (i.e., the mechanism that supplies first belt-shaped film member 121A to first opening end 111 of separate-type tubular film member 110) and the above-mentioned welding mechanism 44

(i.e., the mechanism that joins first opening end 111 of separate-type tubular film member 110 to a portion of first belt-shaped film member 121A by welding), first opening end 111 of separate-type tubular film member 110 is closed by a portion of first belt-shaped film member 121A. Then, the process completes that is performed for the portion of undivided bag-shaped film member 140A shown in FIG. 2 on the right side with respect to cutting line CL shown in the figure.

Referring to FIGS. 5, 6, and 11, then in step S9, second opening end 112 of separate-type tubular film member 110 is spread. Such spreading of second opening end 112 is performed in sixth process zone Z6 of manufacturing apparatus 1A. FIGS. 11(A) and 11(B) each show this spreading operation of second opening end 112 over time.

As shown in FIG. 11(A), in sixth process zone Z6, a plurality of vacuum arms 31' are first used to hold, by vacuum, the portions on the upper surface side and the lower surface side of second opening end 112 of separate-type tubular film member 110. The portions on the upper surface side and the lower surface side of second opening end 112 form a pair of second welding margins 115 as described above. Also, a pair of slits SL are provided in both edges of second opening end 112. Thereby, separate spreading is allowed.

Then, as shown in FIG. 11(B), the plurality of vacuum arms 31' are operated to pivot in the directions away from each other (i.e., in the direction indicated by an arrow AR4' shown in the figure), so that one pair of second welding margins 115 in second opening end 112 are also bent to be away from each other. Thereby, second opening end 112 is opened, with the result that second welding margin 115 formed in a planar shape is located on the second opening end 112 side of separate-type tubular film member 110.

In other words, the above-mentioned sixth process zone Z6 corresponds to the second spreading process region in which second opening end 112 is spread such that second joining margin 115 of separate-type tubular film member 110 is opened.

It is preferable to maintain this opened state of second opening end 112 until a third zone Z73 (see FIG. 12) in seventh process zone Z7 in which welding of second opening end 112 of separate-type tubular film member 110 to a portion of second belt-shaped film member 121B is at least subsequently performed. For example, it is preferable to maintain the above-mentioned state by a separately provided guide member and the like (not shown) when holding by vacuum arms 31' is released.

Referring to FIGS. 5, 6, and 12, then in step S10, second belt-shaped film member 121B is supplied to second opening end 112 of separate-type tubular film member 110. Such supply of second belt-shaped film member 121B is performed in seventh process zone Z7 of manufacturing apparatus 1A. In this case, second belt-shaped film member 121B includes a portion to be formed as top gusset portion 102 of second bag-shaped film member 141B, as described above.

Specifically, as shown in FIG. 12, seventh process zone Z7 of manufacturing apparatus 1A includes a first zone Z71 and a second zone Z72. The plurality of separate-type tubular film members 110 are sequentially conveyed so as to pass through second zone Z72. Single second belt-shaped film member 121B is conveyed so as to pass through first zone Z71 and second zone Z72 in this order.

In first zone Z71, single second belt-shaped film member 121B is fed in its long-side direction from a roll 120B formed by winding single second belt-shaped film member 121B. Such feeding of second belt-shaped film member 121B is implemented by intermittent conveyance for conveying second belt-shaped film member 121B in a step feed manner, and specifically implemented by driving a feeding roller 41' at a prescribed interval.

In first zone Z41, a perforation mechanism 42' is used to provide a hole portion 122 in second belt-shaped film member 121B fed by feeding roller 41'. Also, spout 104 is inserted into hole portion 122 and welded to second belt-shaped film member 121B by a welding mechanism 43'. Perforation mechanism 42' includes a cutting blade and a drive mechanism that drives the cutting blade. The cutting blade moves in the direction indicated by an arrow AR5' shown in the figure to thereby form hole portion 122. Welding mechanism 43' includes a heater and a drive mechanism that drives the heater. The heater moves in the direction indicated by an arrow AR6' shown in the figure to thereby weld spout 104. Thus, spout 104 is attached to second belt-shaped film member 121B with welding portion W2 interposed therebetween.

In the present embodiment, spout 104 is attached to second belt-shaped film member 121B in first zone Z71 as described above. Alternatively, a spouted second belt-shaped film member provided with spouts in advance at prescribed intervals may be used.

In second zone Z72, second belt-shaped film member 121B to which spout 104 is welded is supplied to second opening end 112 of separate-type tubular film member 110 so as to overlap with opened second welding margin 115 of separate-type tubular film member 110. Specifically, by using a guide roller and the like as the second supply mechanism, second belt-shaped film member 121B is conveyed in the same direction as conveyance direction DR2 of separate-type tubular film member 110, and thus, conveyed in parallel with separate-type tubular film member 110, and also conveyed at the same speed as the conveyance speed of separate-type tubular film member 110.

Thereby, in second zone Z72, a portion of second belt-shaped film member 121B is brought into contact with second welding margin 115 of separate-type tubular film member 110. In this case, the timings at which these members are conveyed are synchronously controlled, so that the portion of second belt-shaped film member 121B is brought into contact with second joining margin 115 in the state where spout 104 is properly positioned.

Referring to FIGS. 5, 6, and 12, then in step S11, second belt-shaped film member 121B is welded to second opening end 112 of separate-type tubular film member 110. Such welding of second belt-shaped film member 121B is performed in seventh process zone Z7 of manufacturing apparatus 1A.

Specifically, as shown in FIG. 12, seventh process zone Z7 of manufacturing apparatus 1A includes a third zone Z73 in addition to first zone Z71 and second zone Z72 as described above. Separate-type tubular film member 110 and second belt-shaped film member 121B are conveyed to third zone Z73 in the state where a portion of second belt-shaped film member 121B is brought into contact with second welding margin 115 of separate-type tubular film member 110.

In third zone Z73, welding of second belt-shaped film member 121B to second opening end 112 of separate-type tubular film member 110 is performed using a welding mechanism 44' as the second joining mechanism. Welding mechanism 44' includes a pair of movable stages 44*a*' divided into an upper stage and a lower stage, a heater 44*b*', and a drive mechanism 44*c*'. The pair of movable stages 44*a*' are configured to be movable up and down in the direction indicated by an arrow AR7' shown in the figure so as to be movable close to and away from each other. Heater 44*b*' is configured to be driven by drive mechanism 44*c*' so as to be movable in the direction indicated by an arrow AR8' shown in the figure.

Separate-type tubular film member 110 and second belt-shaped film member 121B that are in contact with each other are disposed at a prescribed position in third zone Z73, so that the pair of movable stages 44*a*' move in the directions to be close to each other. Thereby, the pair of movable stages 44*a*' are disposed on the rear side of second joining margin 115. In this state, heater 44*b*' is driven by drive mechanism 44*c*' to be moved toward the pair of movable stages 44*a*'. Thereby, heater 44*b*' presses second joining margin 115 with second belt-shaped film member 121B interposed therebetween. Thus, a portion of second belt-shaped film member 121B and second joining margin 115 are sandwiched between the pair of movable stages 44*a*' and heater 44*b*', and thereby welded to each other.

Thus, the portion of second belt-shaped film member 121B is attached to second opening end 112 of separate-type tubular film member 110 so as to close second opening end 112 with welding portion W1 interposed therebetween. In other words, second zone Z72 and third zone Z73 in seventh process zone Z7 mentioned above correspond to the second attachment process region in which second opening end 112 of separate-type tubular film member 110 is closed by a portion of second belt-shaped film member 121B.

After completion of this welding, the pair of movable stages 44*a*' and heater 44*b*' move back to their respective retracted positions. Then, these portions having been welded are again conveyed in conveyance direction DR2.

Referring to FIGS. 5, 6, and 12, then in step S12, a redundant portion 107 on the second opening end 112 side in separate-type tubular film member 110 and second belt-shaped film member 121B is removed. Such removal of redundant portion 107 is performed in an eighth process zone Z8 of manufacturing apparatus 1A.

Specifically, as shown in FIG. 12, eighth process zone Z8 of manufacturing apparatus 1A includes a first zone Z81, to which the portions of separate-type tubular film member 110 and second belt-shaped film member 121B that have been welded to each other are conveyed.

In first zone Z81, redundant portion 107 on the second opening end 112 side in separate-type tubular film member 110 and second belt-shaped film member 121B is removed using a cutting mechanism 45'. Cutting mechanism 45' includes a pair of movable stages 45*a*' divided into an upper stage and a lower stage, a cutting blade 45*b*', and a drive mechanism 45*c*'. The pair of movable stages 45*a*' are configured to be movable up and down in the direction indicated by an arrow AR9' shown in the figure so as to be movable close to and away from each other. Cutting blade 45*b*' is configured to be driven by drive mechanism 45*c*' so as to be movable in the direction indicated by an arrow AR10' shown in the figure.

The portions of separate-type tubular film member 110 and second belt-shaped film member 121B that are welded to each other are disposed at a prescribed position in first zone Z81, so that the pair of movable stages 45*a*' move in the directions to be close to each other. Thereby, the pair of movable stages 45*a*' are disposed on the rear side of second joining margin 115. In this state, cutting blade 45*b*' is driven by drive mechanism 45*c*' to be moved toward the pair of movable stages 45*a*'. Thereby, redundant portion 107 on the second opening end 112 side in separate-type tubular film member 110 and second belt-shaped film member 121B is cut and removed.

After removal of redundant portion 107 on the second opening end 112 side completes, the pair of movable stages 45*a*' and cutting blade 45*b*' move back to their respective retracted positions. Then, the above-mentioned welded portions are again conveyed in conveyance direction DR2.

Referring to FIGS. 5, 6, and 12, then in step S13, second belt-shaped film member 121B is separated. Such separation of second belt-shaped film member 121B is performed in eighth process zone Z8 of manufacturing apparatus 1A.

Specifically, as shown in FIG. 12, eighth process zone Z8 of manufacturing apparatus 1A includes a second zone Z82 in addition to the above-mentioned first zone Z81. To this second zone Z82, second belt-shaped film member 121B that connects separate-type tubular film members 110 adjacent to each other in conveyance direction DR2 is conveyed.

In second zone Z82, a cutting mechanism 46' is used to cut second belt-shaped film member 121B. Cutting mechanism 46' having a pair of cutting blades moves up and down in the direction indicated by an arrow AR11' shown in the figure, to thereby cut and remove the portion of second belt-shaped film member 121B that connects separate-type tubular film members 110 adjacent to each other (i.e., the portion indicated by a reference character 124 in the figure).

In other words, second zone Z82 of eighth process zone Z8 mentioned above corresponds to the second cutting process region in which the portion of single second belt-shaped film member 121B that closes second opening end 112 of separate-type tubular film member 110 is cut off from single second belt-shaped film member 121B.

As described above, by the above-mentioned guide roller and the like as the second closing process mechanism (i.e., the mechanism that supplies second belt-shaped film member 121B to second opening end 112 of separate-type tubular film member 110) and the above-mentioned welding mechanism 44' (i.e., the mechanism that joins second opening end 112 of separate-type tubular film member 110 to a portion of second belt-shaped film member 121B by welding), second opening end 112 of separate-type tubular film member 110 is closed by the portion of second belt-shaped film member 121B. Then, the process completes that is performed for the portion of undivided bag-shaped film member 140A shown in FIG. 2 on the left side with respect to cutting line CL shown in the figure. This results in fabrication of undivided bag-shaped film members 140A shown in FIG. 2, which also includes the right side portion having already been processed in step S8.

Referring to FIGS. 5, 6, 13, and 14, then in step S14, undivided bag-shaped film member 140A is conveyed out from the conveyance path, and in step S15, undivided bag-shaped film member 140A is divided. Such conveyance of undivided bag-shaped film member 140A out from the conveyance path and division of undivided bag-shaped film member 140A are performed in a ninth process zone Z9 of manufacturing apparatus 1A. Among these operations, FIGS. 14(A) to 14(C) show the dividing operation over time.

Specifically, as shown in FIG. 13, ninth process zone Z9 of manufacturing apparatus 1A includes a first zone Z91 and a second zone Z92, to which a plurality of undivided bag-shaped film members 140A are sequentially conveyed.

The downstream-side end portion of transporting conveyor 2A includes a conveyance outlet portion that is not covered by pressing conveyor 2B. Undivided bag-shaped film member 140A reaches this conveyance outlet portion. The conveyance outlet portion is provided to extend over first zone Z91 and second zone Z92. When undivided bag-shaped film member 140A reaches first zone Z91, it is released from the pressure applied from pressing conveyor 2B, and then, held by a lift mechanism 91 in second zone Z92. Lift mechanism 91 includes a rotation shaft 91*a*, a plurality of vacuum arms 91*b*, and a drive mechanism 91*c*.

The plurality of vacuum arms 91*b* are configured to be capable of separately holding a portion to be formed as first bag-shaped film member 141A and a portion to be formed as second bag-shaped film member 142A after undivided bag-shaped film members 140A is divided. These vacuum arms 91*b* are fixed to rotation shaft 91*a*. Thus, as rotation shaft 91*a* is driven and rotated by drive mechanism 91*c*, vacuum arms 91*b* pivot in the direction indicated by an arrow AR12 shown in FIG. 14(B) in the state where vacuum arms 91*b* hold undivided bag-shaped film member 140A.

Thereby, undivided bag-shaped film member 140A held by lift mechanism 91 is raised by this lift mechanism 91, and thereby, conveyed out from the conveyance outlet portion.

In this case, cutting mechanism 92 is provided in second zone Z92. Thus, undivided bag-shaped film member 140A raised by lift mechanism 91 is divided by this cutting mechanism 92. Specifically, cutting mechanism 92 includes a stage 92*a*, a cutting blade 92*b*, and a drive mechanism 92*c*.

Cutting blade 92*b* is driven by drive mechanism 92*c* to move in the direction indicated by an arrow AR13 shown in the figure. Thereby, as show in FIGS. 14(A) and 14(B), in the state where undivided bag-shaped film member 140A held by lift mechanism 91 is brought into contact with stage 92*a*, cutting blade 92*b* moves toward stage 92*a* to thereby cut undivided bag-shaped film member 140A along the above-mentioned cutting line CL (see FIG. 2). Thus, undivided bag-shaped film member 140A is cut in the width direction at a mid-position (more strictly, at a middle position) in its axial direction.

Accordingly, on the conveyance path, undivided bag-shaped film member 140A is divided into first bag-shaped film member 141A and second bag-shaped film member 142A. In other words, the above-mentioned second zone Z92 of ninth process zone Z9 corresponds to the third cutting process region in which undivided bag-shaped film member 140A is divided into first bag-shaped film member 141A and second bag-shaped film member 142A.

Then, as shown in FIG. 14(C), as a result of further pivotal movement of vacuum arms 91*b* of lift mechanism 91, first bag-shaped film member 141A and second bag-shaped film member 142A held by lift mechanism 91 are disposed above lift mechanism 91, and released from holding by vacuum arms 91*b*, and thereby, dropped toward a pair of slopes 93 disposed to sandwich lift mechanism 91 therebetween, and then, slid down along the pair of slopes 93 in the direction indicated by an arrow DR3 shown in the figure, and eventually collected therein.

For first bag-shaped film member 141A and second bag-shaped film member 142A collected in this way, the welding process is performed at their other ends (mentioned above) in the axial direction of barrel portion 101 (i.e., each end portion located on the side opposite to the end portion to which top gusset portion 102 is joined). Thereby, manufacturing of pouch container 100A showed in FIG. 1 completes.

According to the manufacturing method for a pouch container in the present embodiment as described above, manufacturing apparatus 1A for a pouch container according to the above-mentioned present embodiment is capable of continuously manufacturing a so-called spouted pouch container 100A in large quantities. Thus, by employing the manufacturing method and manufacturing apparatus 1A according to the present embodiment, a pouch container having a barrel portion and a spouted top gusset portion can be produced in large quantities with high production efficiency.

In this case, in the present embodiment, single first belt-shaped film member 121A and single second belt-shaped film member 121B are conveyed in parallel with separate-type tubular film members 110 at the same speed as the conveyance speed of separate-type tubular film members 110, such that single first belt-shaped film member 121A and single second belt-shaped film member 121B overlap with opened first joining margin 114 and opened second joining margin 115, respectively, of each of separate-type tubular film members 110. Thereby, single first belt-shaped film member 121A and single second belt-shaped film member 121B are supplied to first opening end 111 and second opening end 112, respectively, of each of separate-type tubular film members 110.

Thus, the step of spreading first opening end 111 and second opening end 112 of separate-type tubular film member 110; the step of supplying first belt-shaped film member 121A and second belt-shaped film member 121B to first opening end 111 and second opening end 112, respectively; and the step of welding first belt-shaped film member 121A and second belt-shaped film member 121B to first opening end 111 and second opening end 112, respectively, can be performed as a series of assembly line operations on the conveyance path, thereby achieving high production efficiency.

Furthermore, in the present embodiment, the portion of single first belt-shaped film member 121A that closes first opening end 111 of each of the plurality of separate-type tubular film members 110 is separated from single first belt-shaped film member 121A. Also, the portion of single second belt-shaped film member 121B that closes second opening end 112 of each of the plurality of separate-type tubular film members 110 is separated from single second belt-shaped film member 121B. Thus, such separating steps can be performed as an assembly line operation on the conveyance path subsequent to the above-mentioned series of assembly line operations. Also in this point, high production efficiency is achieved.

Furthermore, the present embodiment provides a configuration in which the first attachment process region and the second attachment process region are provided on conveyance mechanism 2 as the same production line. In the first attachment process region, first opening end 111 of each of the plurality of separate-type tubular film members 110 is closed by a portion of single first belt-shaped film member 121A. In the second attachment process region, second opening end 112 of each of the plurality of separate-type tubular film members 110 is closed by a portion of single second belt-shaped film member 121B. Thus, the above-mentioned supplying step and welding step can be performed in a series of assembly line operations without performing, for example, transfer of a workpiece. Also in this point, the production efficiency is improved.

First Modification

Figure 15:
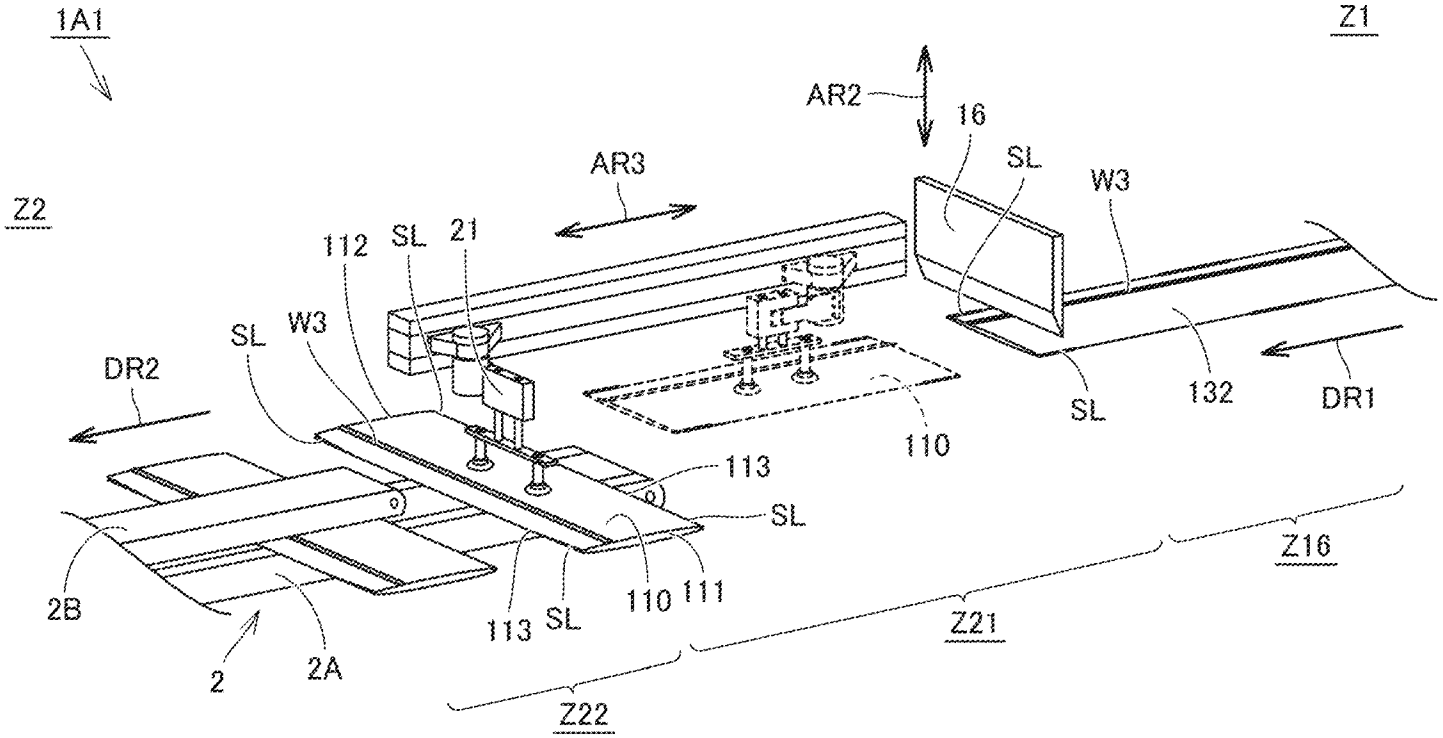
FIG. 15 is a schematic perspective view showing a part of a first process zone and a second process zone in a manufacturing apparatus for a pouch container according to the first modification.

FIG. 15 is a schematic perspective view showing a part of the first process zone and the second process zone in a manufacturing apparatus for a pouch container according to the first modification based on the above-mentioned first embodiment. Referring to FIG. 15, a manufacturing apparatus 1A1 according to the first modification will be hereinafter described.

Manufacturing apparatus 1A according to the above-mentioned first embodiment is designed such that feed direction DR1 of elongated tubular film member 132 in first process zone Z1 is orthogonal to conveyance direction DR2 of separate-type tubular film member 110 in second process zone Z2. In contrast, manufacturing apparatus 1A1 according to the present modification is designed such that feed direction DR1 and conveyance direction DR2 extend in the same direction, as shown in FIG. 15.

In order to implement this design, manufacturing apparatus 1A1 according to the present modification includes transfer mechanism 21 that includes not only the pair of vacuum arms and the guide rail as mentioned above but also a pivot mechanism that causes the pair of vacuum arms to pivot. Thereby, separate-type tubular film member 110 held by the pair of vacuum arms changes its orientation due to pivotal movement of the pair of vacuum arms caused by the pivot mechanism, so that feed direction DR1 and conveyance direction DR2 extend in the same direction.

The configuration as described above can also achieve basically the same effect as that described in the above first embodiment.

Second Modification

Figure 16:
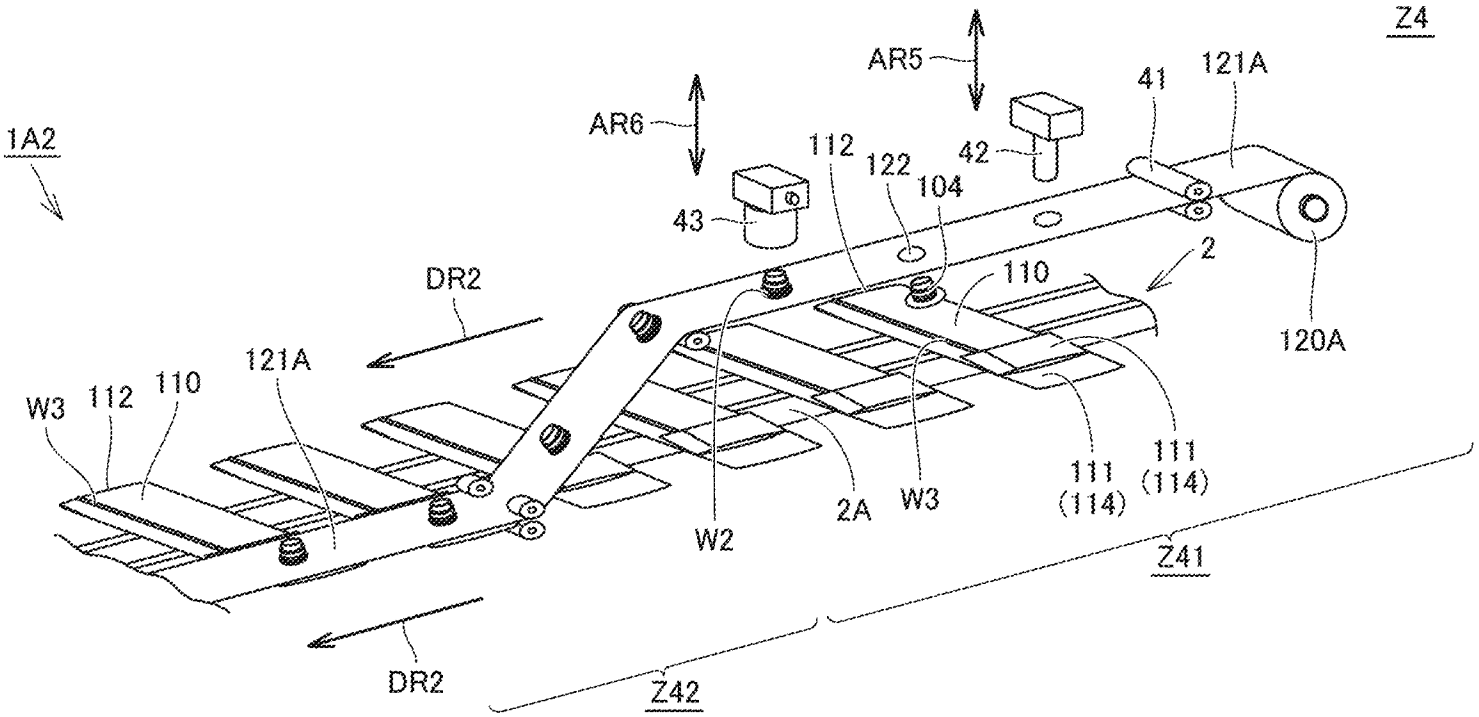
FIG. 16 is a schematic perspective view showing a part of a fourth process zone in a manufacturing apparatus for a pouch container according to the second modification.

FIG. 16 is a schematic perspective view showing a part of a fourth process zone in a manufacturing apparatus for a pouch container according to the second modification based on the above-mentioned first embodiment. Referring to this FIG. 16, a manufacturing apparatus 1A2 according to the second modification will be hereinafter described.

Manufacturing apparatus 1A according to the above-mentioned first embodiment is configured as follows. Specifically, in the step of spreading first opening end 111 of separate-type tubular film member 110, the above-mentioned one pair of first joining margins 114 are spread in the directions away from each other. Thereby, in the step of supplying first belt-shaped film member 121A to first opening end 111 of separate-type tubular film member 110, first belt-shaped film member 121A is supplied to first opening end 111 in a posture in which a pair of main surfaces of first belt-shaped film member 121A face horizontally (i.e., a posture in which the thickness direction of first belt-shaped film member 121A extends horizontally). However, as shown in FIG. 16, manufacturing apparatus 1A2 according to the present modification is configured as follows. Specifically, in the step of spreading first opening end 111 of separate-type tubular film member 110, only the joining margin on the upper surface side of the above-mentioned pair of first joining margins 114 is spread to be folded back so as to be away from the joining margin on the lower surface side. Thereby, in the step of supplying first belt-shaped film member 121A to first opening end 111 of separate-type tubular film member 110, first belt-shaped film member 121A is supplied to first opening end 111 in a posture in which a pair of main surfaces of first belt-shaped film member 121A face vertically (i.e., a posture in which the thickness direction of first belt-shaped film member 121A extends vertically).

The configuration as described above can also achieve basically the same effect as that described in the above first embodiment. It should be noted that the similar configuration can be applied also in the step of spreading second opening end 112 of separate-type tubular film member 110 and the step of supplying second belt-shaped film member 121B to second opening end 112 of separate-type tubular film member 110.

Third Modification

Figure 17:
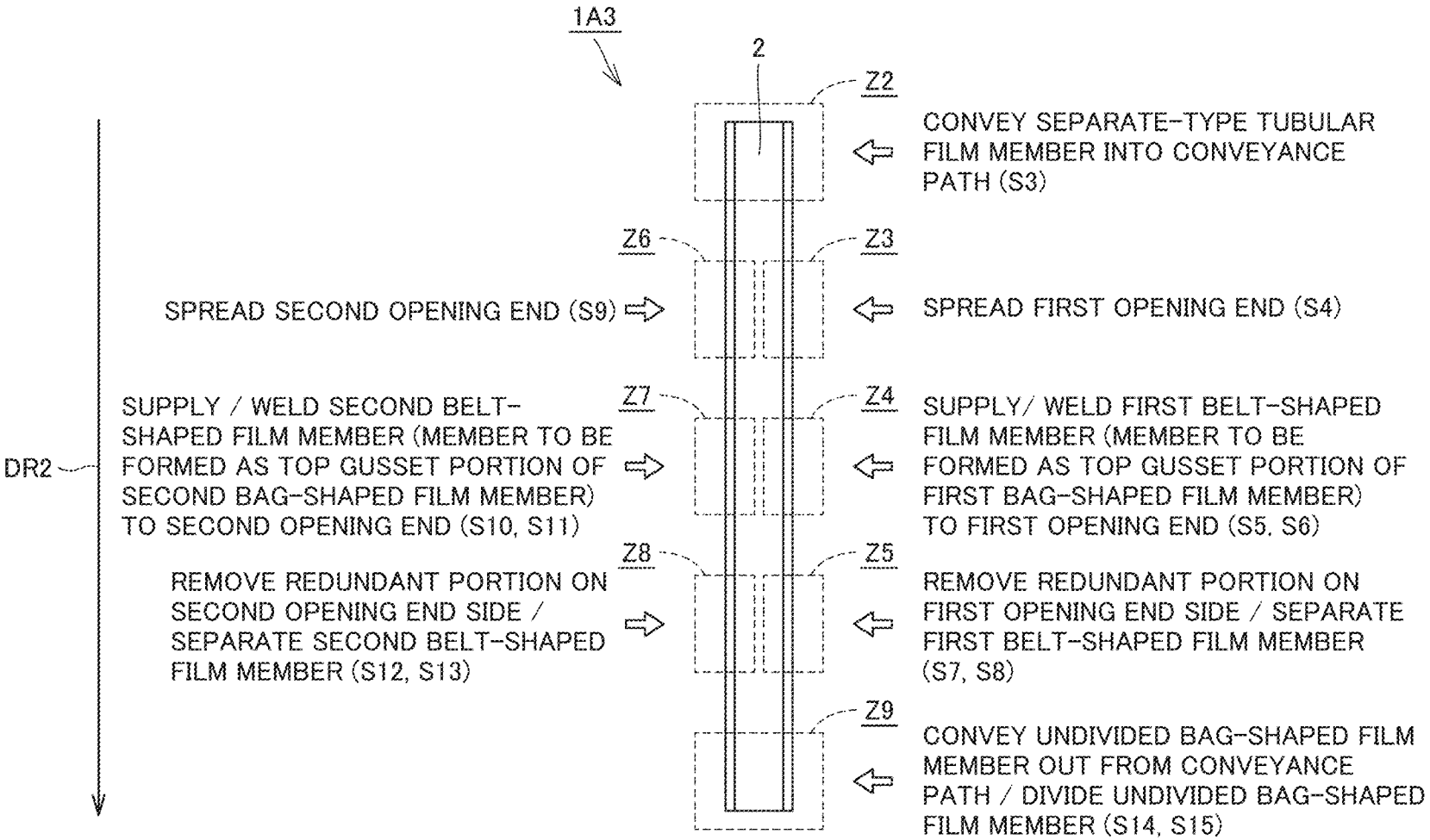
FIG. 17 is a schematic diagram showing a process flow on a conveyance path of a manufacturing apparatus for a pouch container according to the third modification.

FIG. 17 is a schematic diagram showing a process flow on a conveyance path of a manufacturing apparatus for a pouch container according to the third modification based on the above-mentioned first embodiment. Referring to this FIG. 17, a manufacturing apparatus 1A3 according to the third modification will be hereinafter described.

Manufacturing apparatus 1A according to the above-described first embodiment is configured as follows. Specifically, the step of closing first opening end 111 of separate-type tubular film member 110 by a portion of first belt-shaped film member 121A is followed by the step of closing second opening end 112 of separate-type tubular film member 110 by a portion of second belt-shaped film member 121B. As shown in FIG. 17, however, manufacturing apparatus 1A3 according to the present modification is configured such that these steps are simultaneously performed.

In other words, in manufacturing apparatus 1A3 according to the present modification, third process zone Z3 and sixth process zone Z6 are provided at the same position along conveyance direction DR2 of the workpiece in conveyance mechanism 2 such that the above-mentioned step S4 and step S9 are performed substantially at the same timing. Also, fourth process zone Z4 and seventh process zone Z7 are provided at the same position along conveyance direction DR2 of the workpiece in conveyance mechanism 2 such that the above-mentioned steps S5 and S6 are performed substantially at the same timings as steps S10 and S11, respectively. Further, fifth process zone Z5 and eighth process zone Z8 are provided at the same position along conveyance direction DR2 of the workpiece in conveyance mechanism 2 such that the above-mentioned steps S7 and S8 are performed substantially at the same timings as steps S12 and S13, respectively. The same position along conveyance direction DR2 of the workpiece means the bilaterally symmetrical position on the conveyance path, and more specifically means the line-symmetrical position with respect to the central line extending in the long-side direction of the conveyance path in a plan view of the conveyance path.

The configuration as described above can also achieve basically the same effect as that described in the above first embodiment. Furthermore, in the configuration as described above, the step of closing first opening end 111 of each of the plurality of separate-type tubular film members 110 by a portion of single first belt-shaped film member 121A is performed substantially at the same timing as the step of closing second opening end 112 of each of the plurality of separate-type tubular film members 110 by a portion of single second belt-shaped film member 121B. Accordingly, the time required to manufacture pouch container 100A can be significantly shortened while the length of conveyance mechanism 2 can be significantly shortened, so that the footprint of the manufacturing apparatus can be significantly reduced.

Second Embodiment

Figure 18:
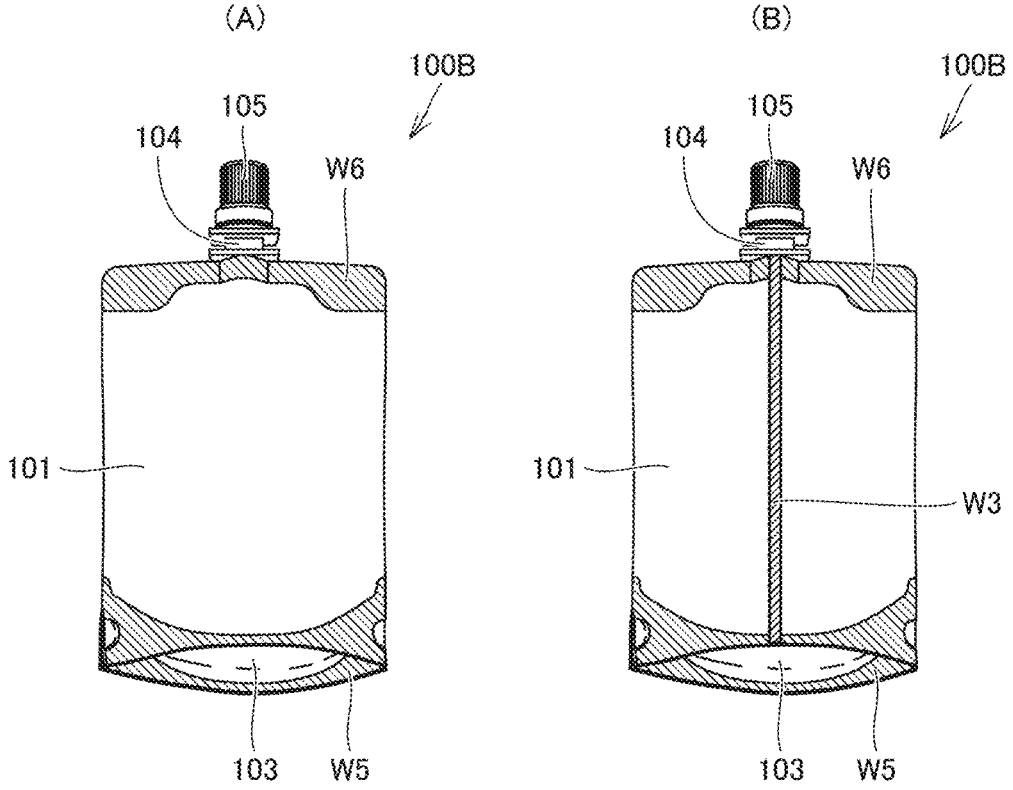
FIG. 18 is a perspective view showing an external shape of a pouch container manufactured in accordance with a manufacturing method for a pouch container according to the second embodiment of the present invention.

FIG. 18 is a view showing an external shape of a pouch container manufactured in accordance with a manufacturing method for a pouch container according to the second embodiment of the present invention. FIG. 18(A) is a perspective view showing the front surface and the bottom surface of the pouch container. FIG. 18(B) is a perspective view showing the back surface and the bottom surface of the pouch container. Referring to this FIG. 18, a pouch container 100B manufactured in accordance with the manufacturing method for a pouch container according to the present embodiment will be first described. In FIG. 18, portions corresponding to welding portions W3, W5, and W6 (described later) are represented by oblique lines in order to facilitate understanding (the same also applies to FIGS. 19 and 22).

As shown in FIGS. 18(A) and 18(B), pouch container 100B is a so-called stand-up type spouted pouch container, and mainly includes a barrel portion 101, a bottom gusset portion 103, and a spout 104. Spout 104 is provided at the end portion of barrel portion 101 on the side opposite to bottom gusset portion 103. Also, a cap 105 is detachably attached to spout 104.

Barrel portion 101 is formed of a tubular film member formed by welding together circumferential end portions of a single film-like member in a rolled state. Thus, while a welding portion W3 extending in the up-down direction is located at a prescribed position on the back surface side of barrel portion 101, no precipitous portion exists on the outer circumferential surface of barrel portion 101 (particularly, at both edges of barrel portion 101 in its width direction), thereby allowing excellent feel of touch.

Bottom gusset portion 103 is formed of a film member intended for a gusset portion and welded to one end in the axial direction of barrel portion 101 so as to close this one end of barrel portion 101. Thereby, a welding portion W5 having a frame shape in a plan view is located on the boundary between barrel portion 101 and bottom gusset portion 103 in the state where bottom gusset portion 103 is spread in a planar shape. Thus, welding portion W5 forms a joint between barrel portion 101 and bottom gusset portion 103.

Furthermore, the other end in the axial direction of barrel portion 101 is closed by welding together wall portions of barrel portion 101 that face each other in the state where barrel portion 101 is flatly folded. Thereby, a welding portion W6 extending in the right-left direction is located at the other end of barrel portion 101.

Spout 104 is formed of a cylindrical member having an outer circumferential surface provided with an external thread, and sandwiched between the above-mentioned wall portions of barrel portion 101 at the above-mentioned other end in the axial direction of barrel portion 101, and thereby welded to barrel portion 101. In other words, the above-mentioned welding portion W6 also forms a joint between barrel portion 101 and spout 104.

In this case, the tubular film member forming barrel portion 101 and the film member intended for a gusset portion and forming bottom gusset portion 103 each are made of the same materials as those of the tubular film member forming barrel portion 101 and the film member intended for a gusset portion and forming top gusset portion 102, each of which has been described in the above first embodiment.

Figure 19:
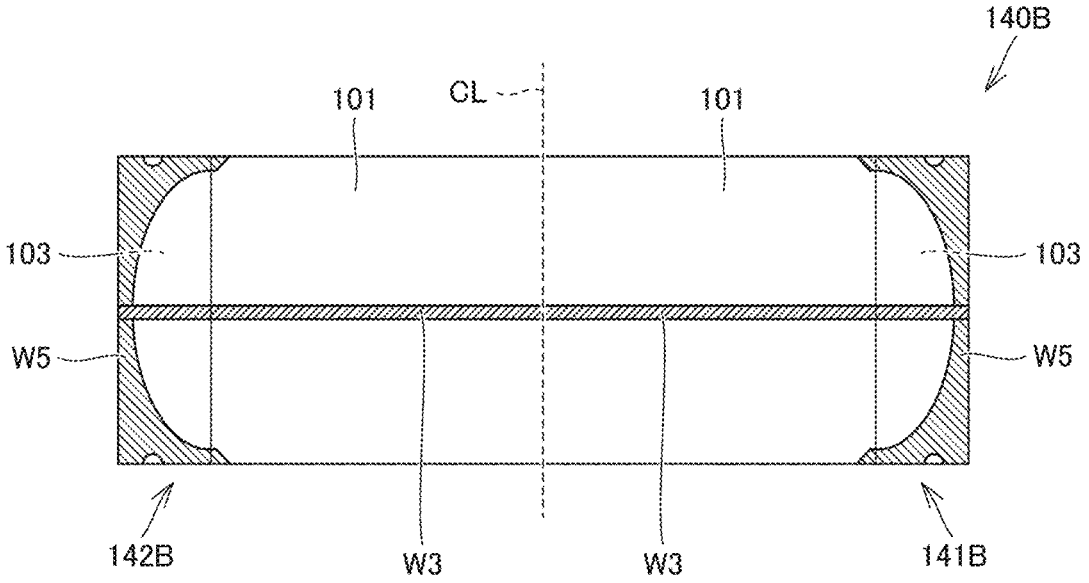
FIG. 19 is a rear view showing an external shape of an undivided bag-shaped film member in one state occurring somewhere during manufacturing of the pouch container shown in FIG. 18.

FIG. 19 is a rear view showing an external shape of an undivided bag-shaped film member in one state occurring somewhere during manufacturing of the pouch container shown in FIG. 18. Referring to FIG. 19, the following describes one state of pouch container 100B during manufacturing shown in FIG. 18.

The manufacturing method for a pouch container according to the present embodiment is to continuously manufacture pouch container 100B shown in FIG. 18 in large quantities by performing various processes (cutting, bending, welding, and the like) for the materials mainly including the first to third belt-shaped film members. In this case, the first belt-shaped film member and the second belt-shaped film member (see FIG. 22 for first belt-shaped film member 121A) each include a plurality of portions each to be formed as bottom gusset portion 103 of pouch container 100B. The third belt-shaped film member includes a plurality of portions each to be formed as barrel portion 101 of pouch container 100B.

Figure 22:
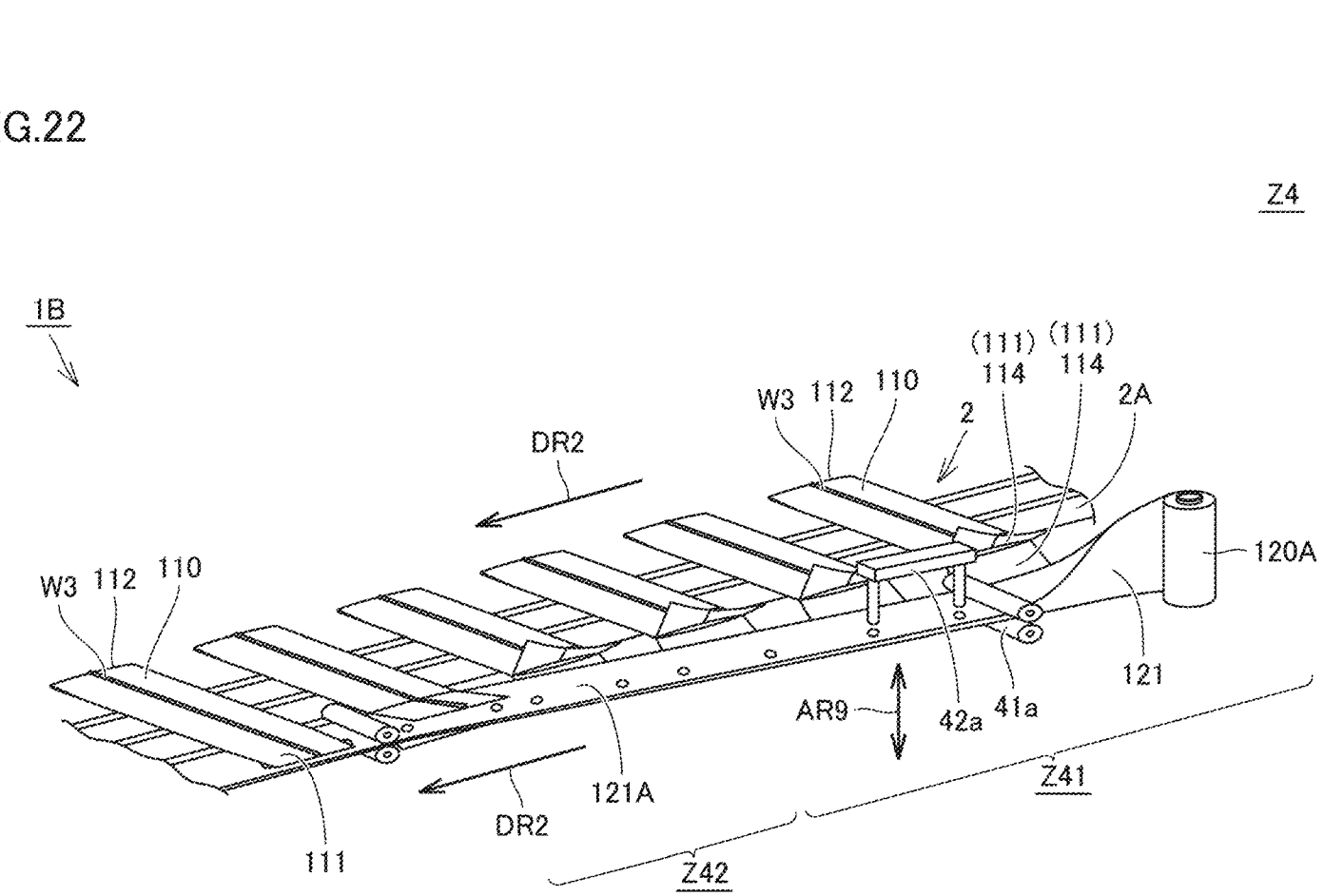
FIG. 22 is a perspective view showing a part of a fourth process zone in the manufacturing apparatus for a pouch container according to the second embodiment of the present invention.

Among them, the third belt-shaped film member is subjected to the above-mentioned various processes to thereby gradually change its shape into an elongated tubular film member and a separate-type tubular film member (see FIG. 22). In this case, separate-type tubular film member 110 includes two portions each to be formed as barrel portion 101 of pouch container 100B.

In other words, similarly to the manufacturing method for a pouch container according to the above-mentioned first embodiment, the manufacturing method for a pouch container according to the present embodiment is to process two pouch containers 100B as one workpiece until one stage somewhere in the manufacture steps after separate-type tubular film member 110 is fabricated. Then, this one workpiece is divided so as to eventually obtain two pouch containers 100B from this one workpiece. Thus, the state before one workpiece is divided corresponds to the state of undivided bag-shaped film member 140B shown in FIG. 19.

As shown in FIG. 19, undivided bag-shaped film member 140B is cut along cutting line CL shown in the figure so as to be divided into first bag-shaped film member 141B and second bag-shaped film member 142B. The above-mentioned other end in the axial direction of barrel portion 101 of first bag-shaped film member 141B (i.e., the end portion located on the side opposite to the end portion to which bottom gusset portion 103 is joined) is continuous to the above-mentioned other end in the axial direction of barrel portion 101 of second bag-shaped film member 142B.

Thus, in undivided bag-shaped film member 140B, bottom gusset portion 103 is welded by welding portion W5 to each of both ends in the axial direction of barrel portion 101. Also, welding portion W3 is formed in barrel portion 101 of first bag-shaped film member 141B and barrel portion 101 of second bag-shaped film member 142B so as to extend over these barrel portions. In addition, spout 104 is held by the other end in the axial direction of bag-shaped film member 141B (142B) to thereby form welding portion W6 (see FIG. 18), and thus, manufacturing of pouch container 100B completes.

Figure 20:
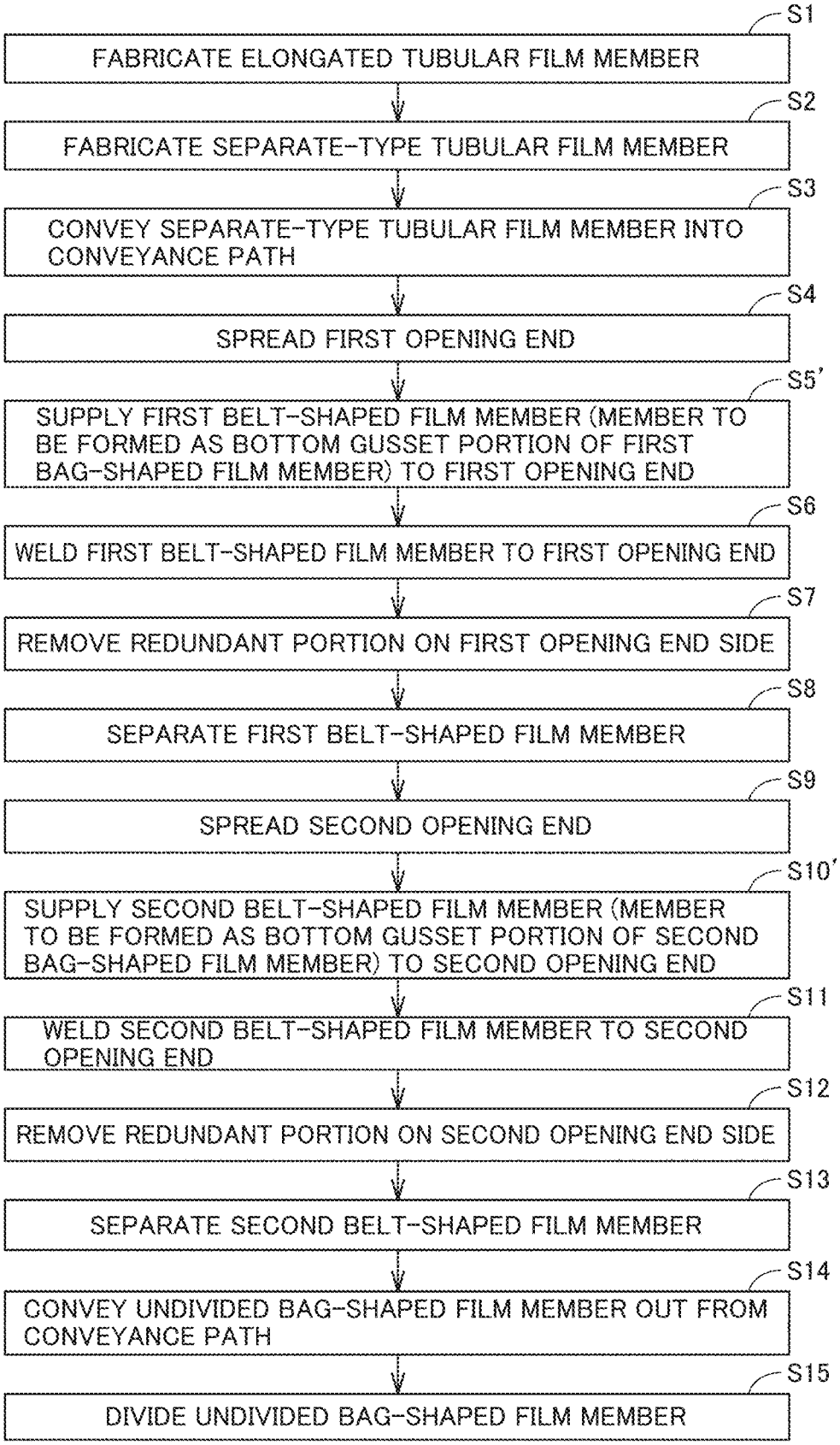
FIG. 20 is a diagram showing a manufacturing flow in accordance with the manufacturing method for a pouch container according to the second embodiment of the present invention.
Figure 21:
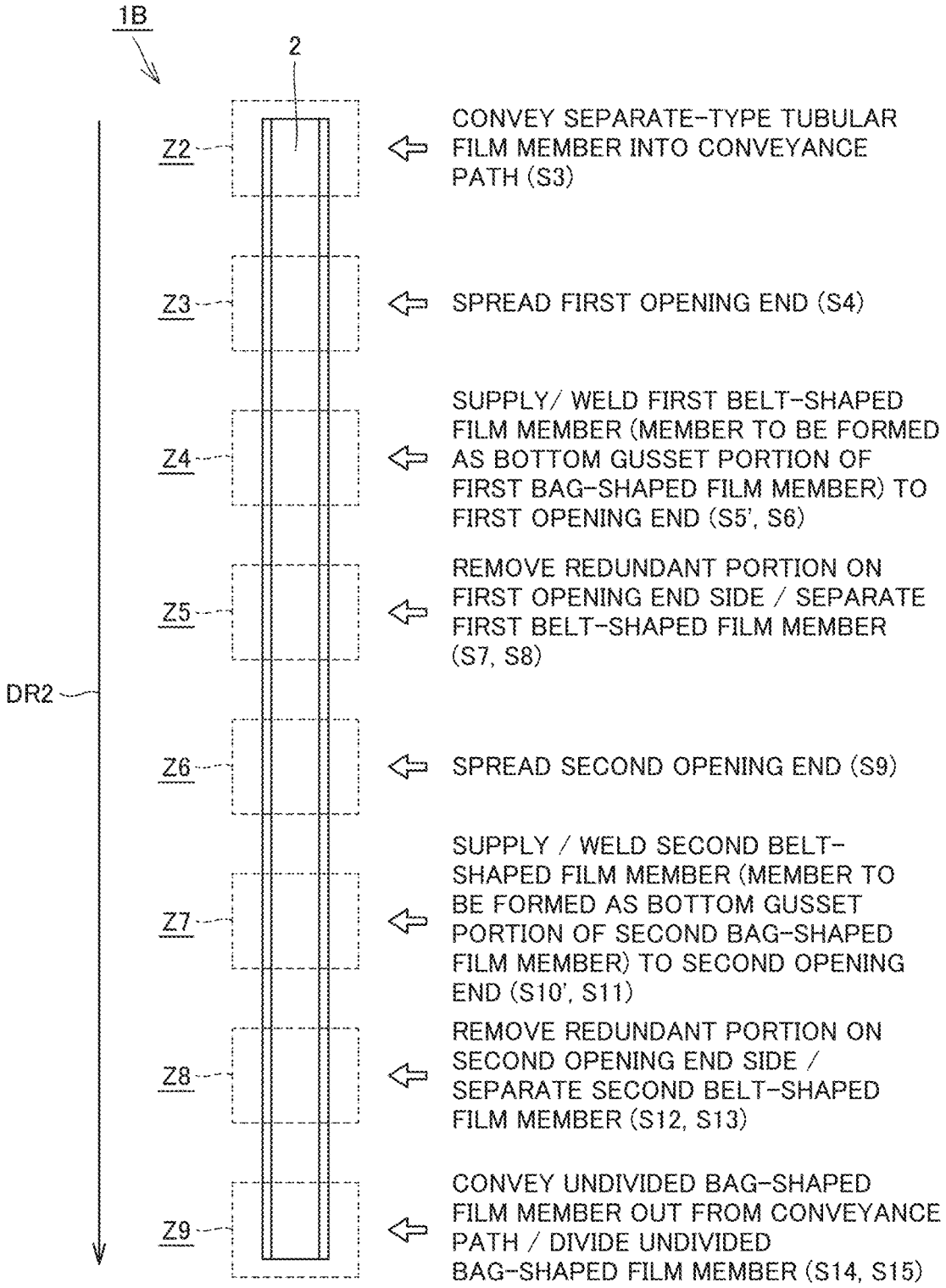
FIG. 21 is a schematic diagram showing a process flow on a conveyance path of a manufacturing apparatus for a pouch container according to the second embodiment of the present invention.

FIG. 20 is a diagram showing a manufacturing flow in accordance with the manufacturing method for a pouch container according to the present embodiment. FIG. 21 is a schematic diagram showing a process flow on a conveyance path in a manufacturing apparatus for a pouch container according to the present embodiment. Furthermore, FIG. 22 is a perspective view showing a part of the fourth process zone shown in FIG. 21. The following describes a manufacturing method and a manufacturing apparatus 1B for a pouch container according to the present embodiment with reference to these FIGS. 20 to 22.

As shown in FIG. 20, the manufacturing method for a pouch container according to the present embodiment is basically similar to the manufacturing method for a pouch container according to the above-mentioned first embodiment, and is different therefrom mainly in that it includes steps S5' and S10' in place of the above-mentioned steps S5 and S10. Thus, only the parts related to these steps S5' and S10' will be hereinafter described.

In step S5', first belt-shaped film member 121A including a plurality of portions each to be formed as bottom gusset portion 103 of first bag-shaped film member 141B is supplied to first opening end 111 of separate-type tubular film member 110. In step S10', second belt-shaped film member including a plurality of portions each to be formed as bottom gusset portion 103 of second bag-shaped film member 142B is supplied to second opening end 112 of separate-type tubular film member 110. These steps S5' and S10' are performed in fourth process zone Z4 and seventh process zone Z7, respectively, of manufacturing apparatus 1B as shown in FIG. 21.

As shown in FIG. 22, fourth process zone Z4 of manufacturing apparatus 1B in which step S5' is performed includes first zone Z41 and second zone Z42. Among these zones, the plurality of separate-type tubular film members 110 are sequentially conveyed so as to pass through second zone Z42. Also, single first belt-shaped film member 121A is conveyed so as to pass through first zone Z41 and second zone Z42 in this order.

In first zone Z41, single first belt-shaped film member 121A is fed in its long-side direction from a roll 120A formed by winding single first belt-shaped film member 121A, and also, the fed first belt-shaped film member 121A is folded over in its short-side direction. Such feeding and folding of first belt-shaped film member 121A are performed by a feeding roller 41*a*. Further, feeding of first belt-shaped film member 121A is implemented by intermittent conveyance for conveying first belt-shaped film member 121A in a step feed manner.

Furthermore, in first zone Z41, a perforation mechanism 42*a* is used to provide a pair of hole portions in first belt-shaped film member 121A fed by feeding roller 41*a*. Perforation mechanism 42*a* includes a cutting blade and a drive mechanism that drives the cutting blade. The cutting blade moves in the direction indicated by an arrow AR14 shown in the figure to thereby form hole portions.

In second zone Z42, first belt-shaped film member 121A provided with a pair of hole portions is supplied to first opening end 111 of separate-type tubular film member 110 so as to overlap with opened first welding margin 114 of separate-type tubular film member 110. Specifically, by using a guide roller and the like as the first supply mechanism, first belt-shaped film member 121A is conveyed in the same direction as conveyance direction DR2 of separate-type tubular film member 110, and thus, conveyed in parallel with separate-type tubular film member 110 and also conveyed at the same speed as the conveyance speed of separate-type tubular film member 110.

Thereby, in second zone Z42, a portion of first belt-shaped film member 121A is brought into contact with first welding margin 114 of separate-type tubular film member 110. In this case, the timings at which these members are conveyed are synchronously controlled, so that the portion of first belt-shaped film member 121A is brought into contact with first joining margin 114 in the state where the pair of hole portions are properly positioned.

Although the detailed explanation will not be herein given, also in seventh process zone Z7 of manufacturing apparatus 1B in which step S10' is performed, the second belt-shaped film member is supplied to second opening end 112 of separate-type tubular film member 110 using a guide roller and the like as the second supply mechanism, as in the above-mentioned step S5'.

After completion of step S15 shown in FIG. 20, for the collected first bag-shaped film member 141B and second bag-shaped film member 142B, the welding process is performed at their other ends in the axial direction of barrel portion 101 (i.e., each end portion located on the side opposite to the end portion to which bottom gusset portion 103 is joined). Thereby, manufacturing of pouch container 100B showed in FIG. 18 completes.

According to the manufacturing method for a pouch container in the present embodiment as described above, manufacturing apparatus 1B for a pouch container according to the above-mentioned present embodiment is capable of continuously manufacturing a so-called stand-up type spouted pouch container 100B in large quantities. Thus, by employing the manufacturing method and manufacturing apparatus 1B according to the present embodiment, a pouch container having a barrel portion and a bottom gusset portion can be produced in large quantities with high production efficiency.

Third Embodiment

Figure 23:
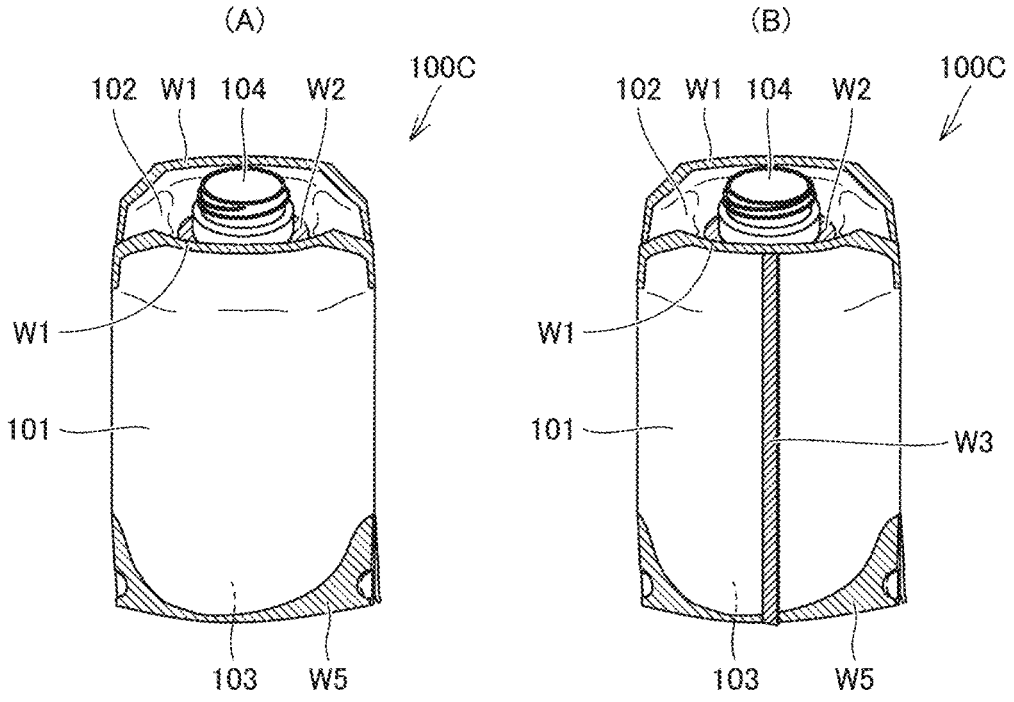
FIG. 23 is a perspective view showing an external shape of a pouch container manufactured in accordance with a manufacturing method for a pouch container according to the third embodiment of the present invention.
Figure 24:
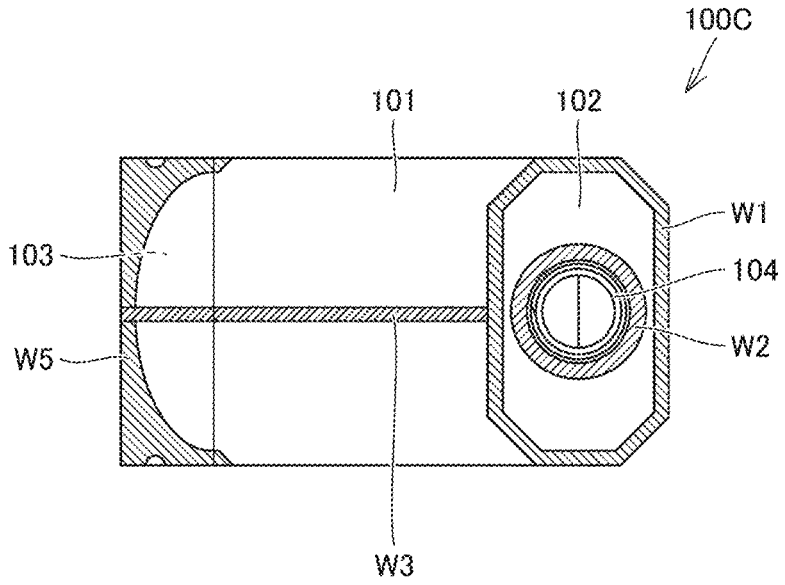
FIG. 24 is a rear view showing the external shape of the pouch container shown in FIG. 23 at the completion of manufacturing of the pouch container.

FIG. 23 is a view showing an external shape of a pouch container manufactured in accordance with a manufacturing method for a pouch container according to the third embodiment of the present invention. FIG. 23(A) is a perspective view showing the front surface and the top surface of the pouch container. FIG. 23(B) is a perspective view showing the back surface and the top surface of the pouch container. FIG. 24 is a rear view showing the external shape of the pouch container shown in FIG. 23 at the completion of manufacturing of this pouch container. Referring to these FIGS. 23 and 24, a pouch container 100C manufactured in accordance with the manufacturing method for a pouch container according to the present embodiment will be first described. In FIGS. 23 and 24, portions corresponding to welding portions W1 to W3, and W5 (described later) are represented by oblique lines in order to facilitate understanding.

As shown in FIGS. 23(A) and 23(B), pouch container 100C is a so-called stand-up type spouted pouch container, and mainly includes a barrel portion 101, a top gusset portion 102, a bottom gusset portion 103, and a spout 104. Spout 104 is provided at top gusset portion 102. Also, a cap (not shown) is detachably attached to spout 104.

Barrel portion 101 is formed of a tubular film member formed by welding together circumferential end portions of a single film-like member in a rolled state. Thus, while welding portion W3 extending in the up-down direction is located at a prescribed position on the back surface side of barrel portion 101, no precipitous portion exists on the outer circumferential surface of barrel portion 101 (particularly, at both edges of barrel portion 101 in its width direction), thereby allowing excellent feel of touch.

Top gusset portion 102 is formed of a film member intended for a gusset portion and welded to one end in the axial direction of barrel portion 101 so as to close this one end of barrel portion 101. Thereby, a welding portion W1 having a frame shape in a plan view is located on the boundary between barrel portion 101 and top gusset portion 102 in the state where top gusset portion 102 is spread in a planar shape. Thus, welding portion W1 forms a joint between barrel portion 101 and top gusset portion 102.

Bottom gusset portion 103 is formed of a film member intended for a gusset portion and welded to the other end in the axial direction of barrel portion 101 so as to close the other end of barrel portion 101. Thereby, a welding portion W5 having a frame shape in a plan view is located on the boundary between barrel portion 101 and bottom gusset portion 103 in the state where bottom gusset portion 103 is spread in a planar shape. Thus, welding portion W5 forms a joint between barrel portion 101 and bottom gusset portion 103.

Spout 104 is formed of a cylindrical member having an outer circumferential surface provided with an external thread, and welded to top gusset portion 102 so as to cover a hole portion provided in a central portion of top gusset portion 102. Thereby, a welding portion W2 is located so as to surround the hole portion provided in top gusset portion 102. Thus, this welding portion W2 forms a joint between top gusset portion 102 and spout 104.

In this case, the tubular film member forming barrel portion 101 and the film member intended for a gusset portion and forming top gusset portion 102 and bottom gusset portion 103 each are made of the same materials as those of the tubular film member forming barrel portion 101 and the film member intended for a gusset portion and forming top gusset portion 102, each of which has been described in the above first embodiment.

The manufacturing method for a pouch container according to the present embodiment is to continuously manufacture pouch container 100C shown in FIG. 23 in large quantities by performing various processes (cutting, bending, welding, and the like) for the materials mainly including the first to third belt-shaped film members. In this case, the first belt-shaped film member includes a plurality of portions each to be formed as top gusset portion 102 of pouch container 100C; the second belt-shaped film member includes a plurality of portions each to be formed as bottom gusset portion 103 of pouch container 100C; and the third belt-shaped film member includes a plurality of portions each to be formed as barrel portion 101 of pouch container 100C.

Among them, the third belt-shaped film member is subjected to the above-mentioned various processes to thereby gradually change its shape into an elongated tubular film member and a separate-type tubular film member. In this case, the separate-type tubular film member includes only one portion to be formed as barrel portion 101 of pouch container 100C.

In other words, unlike the manufacturing method for a pouch container according to each of the above-mentioned first and second embodiments, the manufacturing method for a pouch container according to the present embodiment is to perform a series of processes in the manufacturing steps after a separate-type tubular film member is fabricated, to thereby obtain pouch containers 100C one by one. The state at the completion of manufacturing is shown in FIG. 24.

Thus, as shown in FIG. 24, at the completion of manufacturing, top gusset portion 102 is welded by welding portion W1 to one end in the axial direction of barrel portion 101, bottom gusset portion 103 is welded by welding portion W5 to the other end in the axial direction of barrel portion 101, and spout 104 is welded by welding portion W2 to top gusset portion 102. Also, welding portion W3 is formed in barrel portion 101.

In this way, according to the manufacturing method for a pouch container in the present embodiment, pouch container 100C is directly manufactured without undergoing the state of the undivided bag-shaped film member as in the above-mentioned first embodiment. Accordingly, the process of dividing the undivided bag-shaped film member (i.e., step S15 mentioned above) does not need to be performed.

Figure 25:
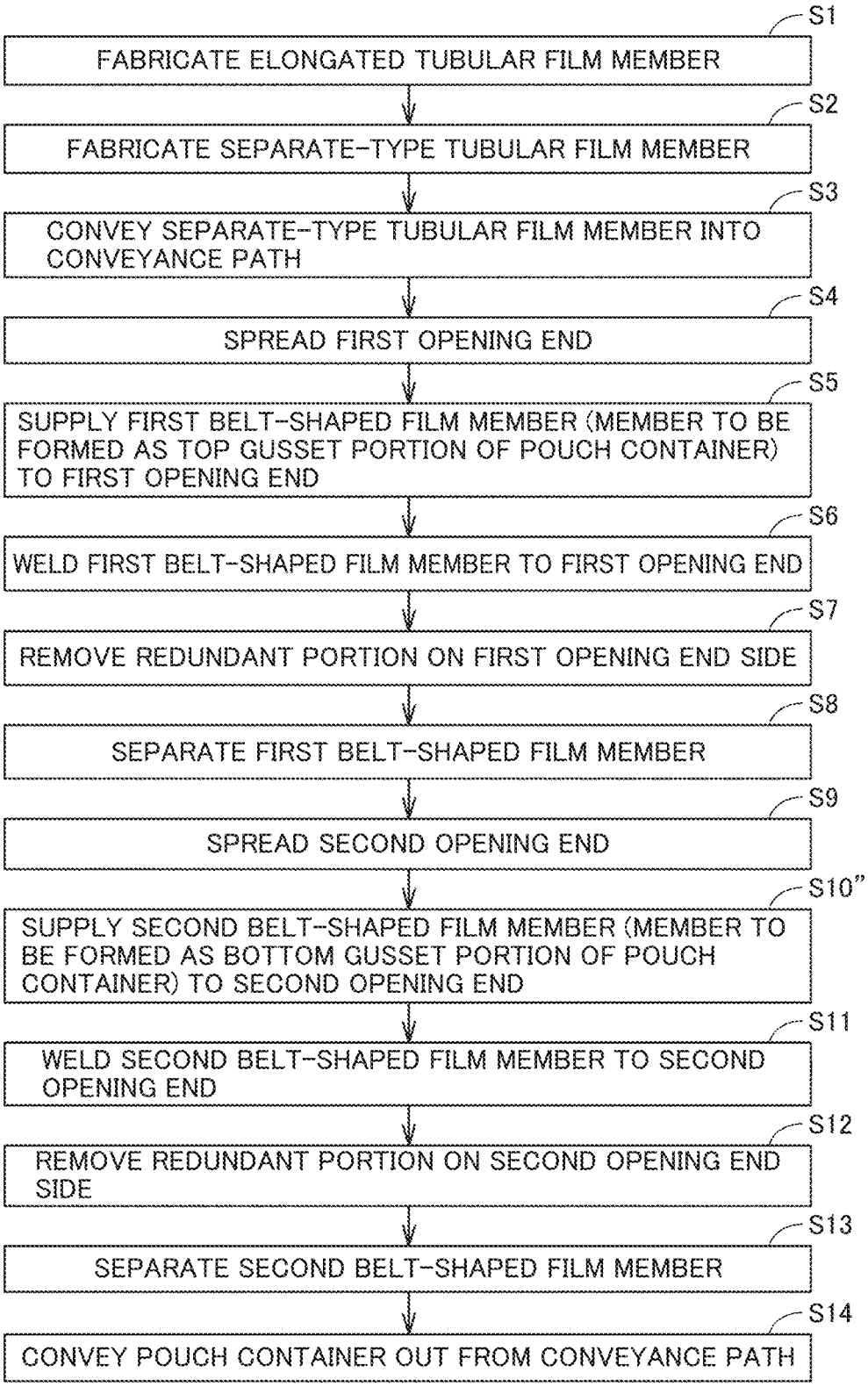
FIG. 25 is a diagram showing a manufacturing flow in accordance with the manufacturing method for a pouch container according to the third embodiment of the present invention.
Figure 26:
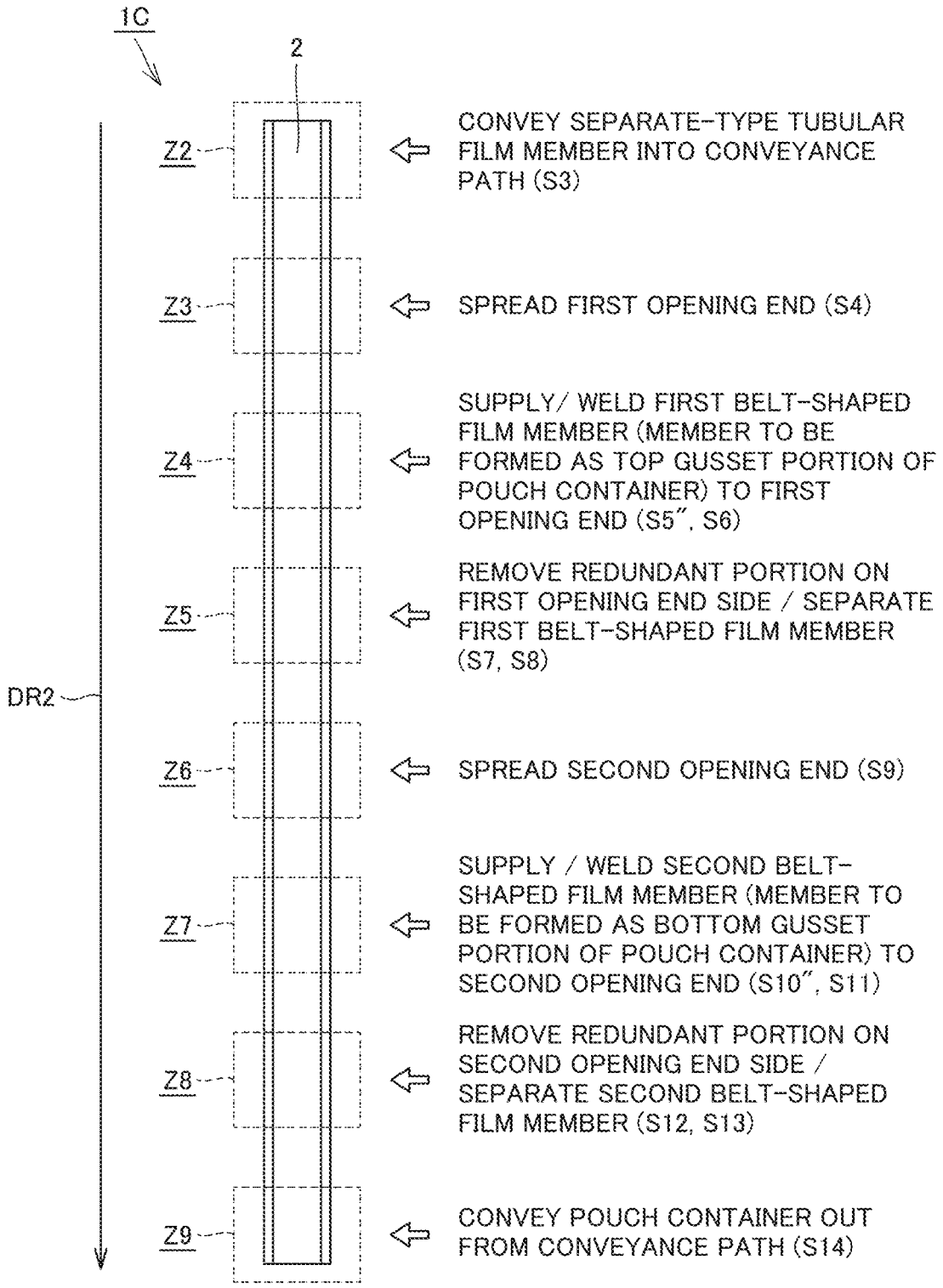
FIG. 26 is a schematic diagram showing a process flow on a conveyance path in a manufacturing apparatus for a pouch container according to the third embodiment of the present invention.

FIG. 25 is a diagram showing a manufacturing flow according to the manufacturing method for a pouch container in the present embodiment. FIG. 26 is a schematic diagram showing a process flow on a conveyance path in a manufacturing apparatus for a pouch container according to the present embodiment. Referring to these FIGS. 25 and 26, the following describes a manufacturing method and a manufacturing apparatus 1C for a pouch container according to the present embodiment.

As shown in FIG. 25, the manufacturing method for a pouch container according to the present embodiment is basically similar to the manufacturing method for a pouch container according to the above-mentioned first embodiment and is different therefrom mainly in that it includes step S10" in place of the above-mentioned step S10, and does not include step S15 as described above. Thus, only the parts related to step S10" will be hereinafter described.

In step S10", the second belt-shaped film member including a plurality of portions each to be formed as bottom gusset portion 103 of pouch container 100C is supplied to the second opening end of the separate-type tubular film member. This step S10" is performed in seventh process zone Z7 of manufacturing apparatus 1C, as shown in FIG. 26.

Such supply of the second belt-shaped film member to the second opening end of the separate-type tubular film member performed in step S10" conforms to step S5' described in the above second embodiment, and therefore, the description thereof will not be repeated.

According to the manufacturing method for a pouch container in the present embodiment as described above, manufacturing apparatus 1C for a pouch container according to the above-mentioned present embodiment is capable of continuously manufacturing a so-called stand-up type spouted pouch container 100C in large quantities. Thus, by employing the manufacturing method and manufacturing apparatus 1C according to the present embodiment, a pouch container having a barrel portion, a bottom gusset portion, and a spouted top plate portion can be produced in large quantities with high production efficiency.

OTHER EMBODIMENTS

The above-mentioned first to third embodiments and modifications thereof in the present invention have been described with reference to the configuration in which a slit formed at each of the end portions on the first opening end side and the second opening end side in the extending direction of each of one pair of bent portions in the separate-type tubular film member is provided by making a cut in advance in the third belt-shaped film member in the state of the third belt-shaped film member as a material of the separate-type tubular film member. However, the timing of forming such a slit is not limited to the above-mentioned timing. For example, after an elongated tubular film member is fabricated, a cut may be made in this elongated tubular film member to thereby form a slit. Alternatively, after a separate-type tubular film member is fabricated, a cut may be made in each of the end portions in a pair of bent portions to thereby form a slit.

Furthermore, the above-mentioned first to third embodiments and modifications thereof in the present invention have been described with reference to the configuration in which the first opening end and the second opening end of the separate-type tubular film member are spread by utilizing an vacuum arm. Alternatively or additionally, a guide member may be inserted or air may be sprayed to thereby spread the first opening end and the second opening end.

Furthermore, the above-mentioned first to third embodiments and modifications thereof in the present invention have been described with reference to the configuration in which the first belt-shaped film member and the second belt-shaped film member are welded to the first opening end and the second opening end, respectively, of the separate-type tubular film member at all the welding portions by one welding process. Alternatively, such one welding process may be divided into a plurality of welding processes which may be performed in a plurality of stages (i.e., partial welding is performed several times for entirely welding all the welding portions).

Furthermore, the above-mentioned first to third embodiments and modifications thereof in the present invention have been described with reference to the case where the present invention is applied to the manufacturing method and the manufacturing apparatus for a pouch container equipped with a spout. However, the present invention is also applicable to a manufacturing method and a manufacturing apparatus for a pouch container not equipped with a spout (by way of example, a stand-up type pouch container that includes a barrel portion and a bottom gusset portion and that can be teared open by hand, and the like). In other words, the present invention is applicable to any manufacturing method and any manufacturing apparatus for a pouch container as long as the pouch container has a barrel portion provided with a gusset portion at least on one end side in its axial direction.

Furthermore, the characteristic configurations described in the above first to third embodiments and modifications thereof can be combined with one another without departing from the gist of the present invention.

In this way, the embodiments and modifications thereof disclosed herein are illustrative and non-restrictive in every respect. The technical scope of the present invention is defined by the terms of the claims, and is intended to include any modifications within the meaning and scope equivalent to the terms of the claims.

REFERENCE SIGNS LIST

1A, 1A1 to 1A3, 1B, and 1C manufacturing apparatus, 2 conveyance mechanism, 2A transporting conveyor, 2B pressing conveyor, 11 feeding roller, 12 cutting mechanism, 13 welding mechanism, 14 cooling mechanism, 15 pressing roller, 16 cutting mechanism, 21 transfer mechanism, 31, 31' vacuum arm, 41, 41', 41*a* feeding roller, 42, 42', 42*a* perforation mechanism, 43, 43' welding mechanism, 44, 44' welding mechanism, 44*a*, 44*a'* movable stage, 44*b*, 44*b'* heater, 44*c*, 44*c'* drive mechanism, 45, 45' cutting mechanism, 45*a*, 45*a'* movable stage, 45*b*, 45*b'* cutting blade, 45*c*, 45*c'* drive mechanism, 46, 46' cutting mechanism, 91 lift mechanism, 91*a* rotation shaft, 91*b* vacuum arm, 91*c* drive mechanism, 92 cutting mechanism, 92*a* stage, 92*b* cutting blade, 92*c* drive mechanism, 100A to 100C pouch container, 101 barrel portion, 101*a* open end, 101*b* one end portion, 101*c* the other end portion, 101*d* seal tape, 102 top gusset portion, 103 bottom gusset portion, 104 spout, 105 cap, 106, 107 redundant portion, 110 separate-type tubular film member, 111 first opening end, 112 second opening end, 113 bent portion, 114 first welding margin, 115 second welding margin, 120A, 120B roll, 121A first belt-shaped film member, 121B second belt-shaped film member, 122 hole portion, 130 roll, 131 third belt-shaped film member, 132 elongated tubular film member, 140A, 140B undivided bag-shaped film member, 141A, 141B first bag-shaped film member, 142A, 142B second bag-shaped film member, CL cutting line, SL slit, W1 to W6 welding portion.

The invention claimed is:

1. A manufacturing method for a pouch container for continuously manufacturing a plurality of pouch containers from materials including:

a plurality of separate-type tubular film members each including a portion to be formed as a barrel portion of a pouch container: a single first belt-shaped film member including a plurality of portions each to be formed as a top gusset portion or a bottom gusset portion of the pouch container; and a single second belt-shaped film member including a plurality of portions each to be formed as a top gusset portion or a bottom gusset portion of the pouch container, the manufacturing method comprising:

conveying each of the separate-type tubular film members in an aligned state on a conveyance path;

closing at least a portion of a first opening end of each of the separate-type tubular film members by a portion of the single first belt-shaped film member in a first attachment process region provided on the conveyance path, wherein the first opening end is located on one end side in an axial direction of each of the separate-type tubular film members; and closing at least a portion of a second opening end of each of the separate-type tubular film members by a portion of the single second belt-shaped film member in a second attachment process region provided on the conveyance path, wherein the second opening end is located on the other end side in the axial direction of each of the separate-type tubular film members, wherein in the conveying each of the separate-type tubular film members, each of the separate-type tubular film members is disposed on the conveyance path in a state where a conveyance direction on the conveyance path is orthogonal to the axial direction, and flatly folded such that a pair of bent portions are formed at both end portions orthogonal to the axial direction, and a cut is made in each of an end portion close to the first opening end and an end portion close to the second opening end in an extending direction of the pair of bent portions, to allow each of the separate-type tubular film members to be conveyed in a state where a first joining margin and a second joining margin are provided in the first opening end and the second opening end, respectively, the closing at least a portion of the first opening end of each of the separate-type tubular film members by a portion of the single first belt-shaped film member includes:

supplying the single first belt-shaped film member to the first opening end of each of the separate-type tubular film members by conveying the single first belt-shaped film member in parallel with the separate-type tubular film members at a same speed as a conveyance speed of the separate-type tubular film members, so as to cause the single first belt-shaped film member to overlap with the first joining margin of each of the separate-type tubular film members, the first joining margin being in an opened state; and joining the first joining margin of each of the separate-type tubular film members to a portion of the single first belt-shaped film member that overlaps with the first joining margin, and the closing at least a portion of the second opening end of each of the separate-type tubular film members by a portion of the single second belt-shaped film member includes:

supplying the single second belt-shaped film member to the second opening end of each of the separate-type tubular film members by conveying the single second belt-shaped film member in parallel with the separate-type tubular film members at a same speed as a conveyance speed of the separate-type tubular film members, so as to cause the single second belt-shaped film member to overlap with the second joining margin of each of the separate-type tubular film members, the second joining margin being in an opened state; and joining the second joining margin of each of the separate-type tubular film members to a portion of the single second belt-shaped film member that overlaps with the second joining margin.

2. The manufacturing method for a pouch container according to claim 1, wherein the first attachment process region and the second attachment process region are provided on a same line.

3. The manufacturing method for a pouch container according to claim 1, wherein the first attachment process region and the second attachment process region are provided at a same position in the conveyance direction, such that the closing at least a portion of the first opening end of each of the separate-type tubular film members by a portion of the single first belt-shaped film member is performed at a same timing as a timing of performing the closing at least a portion of the second opening end of each of the separate-type tubular film members by a portion of the single second belt-shaped film member.

4. The manufacturing method for a pouch container according to claim 1, further comprising:

feeding a single third belt-shaped film member in a long-side direction of the single third belt-shaped film member;

providing pairs of slits at prescribed intervals in the long-side direction in the fed single third belt-shaped film member, wherein slits of each of the pairs of slits are spaced apart from each other in a short-side direction of the single third belt-shaped film member and extend in the long-side direction;

rolling the single third belt-shaped film member into a tube shape in a direction orthogonal to a feed direction of the single third belt-shaped film member, and joining end portions in the short-side direction of the rolled single third belt-shaped film member, to fabricate a single elongated tubular film member; and dividing the single elongated tubular film member along a line crossing each of the pairs of slits to fabricate the separate-type tubular film members.

5. The manufacturing method for a pouch container according to claim 1, further comprising:

before the supplying the single first belt-shaped film member to the first opening end of each of the separate-type tubular film members, spreading the first joining margin of each of the separate-type tubular film members to be opened in a first spreading process region provided on the conveyance path; and before the supplying the single second belt-shaped film member to the second opening end of each of the separate-type tubular film members, spreading the second joining margin of each of the separate-type tubular film members to be opened in a second spreading process region provided on the conveyance path.

6. The manufacturing method for a pouch container according to claim 1, further comprising:

cutting off a portion of the single first belt-shaped film member from the single first belt-shaped film member in a first cutting process region provided on the conveyance path, wherein the portion of the single first belt-shaped film member closes the first opening end of each of the separate-type tubular film members; and cutting off a portion of the single second belt-shaped film member from the single second belt-shaped film member in a second cutting process region provided on the conveyance path, wherein the portion of the single second belt-shaped film member closes the second opening end of each of the separate-type tubular film members.

7. The manufacturing method for a pouch container according to claim 1, wherein one pouch container of a plurality of pouch containers continuously manufactured is formed at least by: one separate-type tubular film member of the separate-type tubular film members; a portion of the single first belt-shaped film member that closes the first opening end of the one separate-type tubular film member; and a portion of the single second belt-shaped film member that closes the second opening end of the one separate-type tubular film member, the one separate-type tubular film member is formed as a barrel portion of the one pouch container, the portion of the single first belt-shaped film member that closes the first opening end of the one separate-type tubular film member is formed as a top gusset portion of the one pouch container, and the portion of the single second belt-shaped film member that closes the second opening end of the one separate-type tubular film member is formed as a bottom gusset portion of the one pouch container.

8. The manufacturing method for a pouch container according to claim 7, wherein each of a plurality of the portions in the single first belt-shaped film member that each are to be formed as a top gusset portion of a pouch container is provided with a spout in advance in a state before each of the plurality of the portions in the single first belt-shaped film member is supplied to the first opening end of each of the separate-type tubular film members.

9. The manufacturing method for a pouch container according to claim 1, further comprising dividing each of the separate-type tubular film members into a first tubular film member and a second tubular film member by cutting off each of the separate-type tubular film members at one position in the axial direction, wherein the first tubular film member includes the first opening end closed by the portion of the single first belt-shaped film member, and the second tubular film member includes the second opening end closed by the portion of the single second belt-shaped film member.

10. The manufacturing method for a pouch container according to claim 9, wherein the dividing each of the separate-type tubular film members into the first tubular film member and the second tubular film member is performed in a third cutting process region provided on the conveyance path.

11. The manufacturing method for a pouch container according to claim 9, wherein one pouch container of a plurality of pouch containers continuously manufactured is formed at least by: one first tubular film member of a plurality of the first tubular film members; and a portion of the single first belt-shaped film member that closes the first opening end of the one first tubular film member, the one first tubular film member is formed as a barrel portion of the one pouch container, the portion of the single first belt-shaped film member that closes the first opening end of the one first tubular film member is formed as a bottom gusset portion of the one pouch container, another pouch container of the pouch containers continuously manufactured is formed at least by: one second tubular film member of a plurality of the second tubular film members; and a portion of the single second belt-shaped film member that closes the second opening end of the one second tubular film member, and the one second tubular film member is formed as a barrel portion of the another pouch container, and the portion of the single second belt-shaped film member that closes the second opening end of the one second tubular film member is formed as a bottom gusset portion of the another pouch container.

12. The manufacturing method for a pouch container according to claim 9, wherein one pouch container of a plurality of pouch containers continuously manufactured is formed at least by: one first tubular film member of a plurality of the first tubular film members; and a portion of the single first belt-shaped film member that closes the first opening end of the one first tubular film member, the one first tubular film member is formed as a barrel portion of the one pouch container, the portion of the single first belt-shaped film member that closes the first opening end of the one first tubular film member is formed as a top gusset portion of the one pouch container, another pouch container of the pouch containers continuously manufactured is formed at least by: one second tubular film member of a plurality of the second tubular film members; and a portion of the single second belt-shaped film member that closes the second opening end of the one second tubular film member, the one second tubular film member is formed as a barrel portion of the another pouch container, and the portion of the single second belt-shaped film member that closes the second opening end of the one second tubular film member is formed as a top gusset portion of the another pouch container.

13. The manufacturing method for a pouch container according to claim 12, wherein each of a plurality of the portions in the single first belt-shaped film member that each are to be formed as a top gusset portion of a pouch container is provided with a spout in advance in a state before each of the plurality of the portions in the single first belt-shaped film member is supplied to the first opening end of each of the separate-type tubular film members, and each of a plurality of the portions in the single second belt-shaped film member that each are to be formed as a top gusset portion of a pouch container is provided with a spout in advance in a state before each of the plurality of the portions in the single second belt-shaped film member is supplied to the second opening end of each of the separate-type tubular film members.

14. A manufacturing apparatus for a pouch container for continuously manufacturing a plurality of pouch containers from materials including: a plurality of separate-type tubular film members each including a portion to be formed as a barrel portion of a pouch container, a single first belt-shaped film member including a plurality of portions each to be formed as a top gusset portion or a bottom gusset portion of the pouch container; and a single second belt-shaped film member including a plurality of portions each to be formed as a top gusset portion or a bottom gusset portion of the pouch container, the manufacturing apparatus comprising:

a conveyance path, on which each of the separate-type tubular film members in an aligned state is conveyed in a state where an axial direction of each of the separate-type tubular film members is orthogonal to a conveyance direction;

a first closing process mechanism that closes at least a portion of a first opening end of each of the separate-type tubular film members by a portion of the single first belt-shaped film member on the conveyance path, wherein the first opening end is located on one end side in the axial direction of each of the separate-type tubular film members; and a second closing process mechanism that closes at least a portion of a second opening end of each of the separate-type tubular film members by a portion of the single second belt-shaped film member on the conveyance path, wherein the second opening end is located on the other end side in the axial direction of each of the separate-type tubular film members, wherein each of the separate-type tubular film members is flatly folded such that a pair of bent portions are formed at both end portions orthogonal to the axial direction, and a cut is made in each of an end portion close to the first opening end and an end portion close to the second opening end in an extending direction of the pair of bent portions, to allow each of the separate-type tubular film members to be conveyed on the conveyance path in a state where a first joining margin and a second joining margin are provided in the first opening end and the second opening end, respectively, the first closing process mechanism includes a first supply mechanism that supplies the single first belt-shaped film member to the first opening end of each of the separate-type tubular film members by conveying the single first belt-shaped film member in parallel with the separate-type tubular film members at a same speed as a conveyance speed of the separate-type tubular film members, so as to cause the single first belt-shaped film member to overlap with the first joining margin of each of the separate-type tubular film members, the first joining margin being in an opened state, and a first joining mechanism that joins the first joining margin of each of the separate-type tubular film members to a portion of the single first belt-shaped film member that overlaps with the first joining margin, and the second closing process mechanism includes a second supply mechanism that supplies the single second belt-shaped film member to the second opening end of each of the separate-type tubular film members by conveying the single second belt-shaped film member in parallel with the separate-type tubular film members at a same speed as a conveyance speed of the separate-type tubular film members, so as to cause the single second belt-shaped film member to overlap with the second joining margin of each of the separate-type tubular film members, the second joining margin being in an opened state, and a second joining mechanism that joins the second joining margin of each of the separate-type tubular film members to a portion of the single second belt-shaped film member that overlaps with the second joining margin.

* * * * *